US005240824A

United States Patent [19]

Takada et al.

[11] Patent Number: 5,240,824

[45] Date of Patent: Aug. 31, 1993

[54] SILVER HALIDE PHOTOGRAPHIC LIGHT-SENSITIVE MATERIAL HAVING A HIGH SENSITIVITY AND IMPROVED PRESERVABILITY AND A PROCESS FOR PRODUCING THE SAME

[75] Inventors: Hiroshi Takada; Syoji Matsuzaka; Hideaki Haraga; Atsuo Ezaki; Koji Tashiro, all of Hino, Japan

[73] Assignee: Konica Corporation, Tokyo, Japan

[21] Appl. No.: 654,221

[22] Filed: Feb. 12, 1991

[30] Foreign Application Priority Data

Feb. 15, 1990 [JP] Japan ..... 2-34186
Feb. 15, 1990 [JP] Japan ..... 2-34787

[51] Int. Cl.[5] ..... G03C 1/005
[52] U.S. Cl. ..... 430/567; 430/569
[58] Field of Search ..... 430/567, 569

[56] References Cited

U.S. PATENT DOCUMENTS 4,210,450 7/1980 Corben ..... 430/567
4,713,318 12/1987 Sugimoto et al. .
4,879,208 11/1989 Urabe .
5,021,323 6/1991 Yamamoto .
5,045,443 9/1991 Urabe ..... 430/567

FOREIGN PATENT DOCUMENTS 202784 11/1986 European Pat. Off. .
264954 4/1988 European Pat. Off. .
323215 7/1989 European Pat. Off. .

OTHER PUBLICATIONS

Patent Abstracts of Japan, vol. 11, No. 340(P-634)(2787); Nov. 7, 1987, JPA-62-123445; Jun. 4, 1987.

*Primary Examiner*—Charles L. Bowers, Jr.
*Assistant Examiner*—Thorl Chea
*Attorney, Agent, or Firm*—Jordan B. Bierman

[57] ABSTRACT

A silver halide photographic light-sensitive material is disclosed which comprises a support and, provided thereon, a silver halide emulsion layer comprising silver halide grains having a surface phase and an internal phase adjacent to said surface phase. The internal phase has a thickness of 100 Å, and the silver iodide content of the surface phase is higher than that of the internal phase.

24 Claims, No Drawings

SILVER HALIDE PHOTOGRAPHIC LIGHT-SENSITIVE MATERIAL HAVING A HIGH SENSITIVITY AND IMPROVED PRESERVABILITY AND A PROCESS FOR PRODUCING THE SAME

FIELD OF THE INVENTION

The present invention relates to a silver halide light-sensitive photographic material, and more particularly to a silver halide photographic light-sensitive material having a high sensitivity and an excellent preservability under high temperature/humidity conditions, and a process for producing the same.

BACKGROUND OF THE INVENTION

Silver halide photographic light-sensitive materials are required to have various characteristics, of which the sensitivity and preservability under high temperature/humidity conditions largely affect the ease of handling of light-sensitive materials for photographing and print-making use.

For example, a light-sensitive material for photographing use is required to have a sensitivity as high as ISO 400 or more in consideration of being used in an inexpensive disposable camera having a lens aperture of F8 to F11 and a shutter speed of about 1/100 sec, and further used under severe outdoor exposure conditions such as in the beach, poolside and rainy weather.

Also in the color print-making field, with the recent increase in the number of mini-photofinisher labs, there has been an increasing demand for high-speed light-sensitive materials which enables to make prints in a shorter time suitable for over-the-counter processing and which has an excellent preservability; i.e., whose characteristics are stable over a long period of time even under high humidity conditions.

In order to obtain a high sensitivity, attempts have conventionally been made to raise both light-absorbability and developability of silver halide. For example, a silver iodobromide light-sensitive material uses core/-shell-type silver halide grains in which the silver iodide content of the core is higher than that of the shell. This technical means, however, has the problem that as the iodide content of the shell becomes reduced, it becomes harder for the light-sensitive material to obtain an intended color sensitivity for its inherent high sensitivity, or the sensitivity becomes deteriorated under high temperature/humidity conditions.

The color sensitivity can be improved by increasing the iodide content of the surface of silver halide grains. The conventional techniques for increasing the silver iodide content of the surface of silver halide grains include a technique for increasing the silver iodide content of the shell of an internal high iodide content-type core/shell grains and the technique for the internal low iodide content-type core/shell grains described in Japanese Patent Publication Open to Public Inspection (hereinafter referred to as JP O.P.I.) No. 284848/1989.

In the core/shell grains, however, if the silver iodide content of the shell is increased, the chemically sensitized nuclei formed by chemical sensitization are dispersed to cause the grains to be considerably desensitized and further the developability to be largely reduced.

JP O.P.I. No. 106745/1988 discloses a technique producing a low iodide-content shell to cover silver grains with a layer having a thickness of about 50 Å containing silver iodide of 5 mole % or more. Even this method, however, has not attained the solution of the problems of deterioration of the initial developability and dispersion of the chemically sensitized nuclei because the high iodide content layer on the grains surface has a thickness of more than 10 lattices.

JP O.P.I. Nos. 51627/1973 and 77443/1984 disclose a method of adding a water-soluble iodide to a silver iodobromide emulsion for the purpose of improving the color sensitivity.

The above method is useful for increasing the adsorption of a sensitizing dye to the surface of silver halide grains to control the spectral sensitivity distribution thereof or for reducing the desorption of the sensitizing dye under high temperature/humidity conditions, but has the disadvantage that if the water-soluble iodide is added until the adsorption of the sensitizing dye is sufficiently raised, then the sensitivity of the silver halide is lowered. In this method, probably because the adsorption reaction of the iodide ion to the surface of silver halide grains is very rapid and the adsorption is neither uniform nor stable, there are cases where the sensitivity of the resulting silver halide grains changes with time even when stored in a refrigerator, and thus it is difficult to produce a light-sensitive material product having a stable quality.

On the other hand, known as a means for increasing the sensitivity and improving the preservability of a silver chlorobromide emulsion is the method of adding a water-soluble bromide or a water-soluble iodide to the emulsion as described in JP O.P.I. Nos. 96331/11982 and 5238/11984.

However, this method, when a water-soluble bromide alone is added, requires the addition of the bromide in an amount of 5 to 50 mole % per mole of silver, which, in processing, causes an adverse effect such as sensitivity drop or contrast reduction due to the flow-out of the bromide ion in the processing solution. Where a water-soluble bromide and a water-soluble iodide are used in combination, probably because the adsorption reaction of the iodide ion is not uniform or unstable, very conspicuous changes in the photographic characteristics such as sensitivity drop, contrast reduction and increase in fog occur during the period between the emulsion preparation and the emulsion coating, and therefore it is difficult to produce a photographic light-sensitive material having a stable quality.

Thus, the conventional techniques to solve the problems of the color sensitivity drop and preservability deterioration particularly under high temperature/humidity conditions that occur in high sensitization of silver halide emulsions having various compositions are terribly insufficient.

SUMMARY OF THE INVENTION

It is therefore an object of the invention to provide a silver halide photographic light-sensitive material having a high sensitivity and an excellent preservability under high temperature/humidity conditions.

It is another object of the invention to provide a silver halide photographic light-sensitive material having a stable quality with no changes in the photographic characteristics during the period of from the emulsion preparation to the emulsion coating.

The above objects of the invention can be accomplished by a silver halide photographic light-sensitive material having a support and, provided thereon, a silver halide emulsion layer comprising silver halide grains having a surface phase and an internal phase adjacent to said surface phase, said internal phase having a thickness of 100 Å, wherein the silver iodide content of said surface phase is higher than that of said internal phase; and also accomplished by a process for manufacturing a silver halide photographic light-sensitive material having a support and, provided thereon, a silver halide emulsion layer comprising silver halide grains, said silver halide grains being prepared by a method comprising adding fine-grained silver halide grains represented by the following Formula 1 at a stage from a chemical ripening stage to a coating stage to mother grains whose halogen composition of the outermost phase is $AgCl_aBr_bI_c$, wherein $0 \leqq a \leqq 1$, $0 \leqq b \leqq 1$, $0 \leqq c \leqq 0.2$, and $a+b+c=1$;

$$AgCl_{a'}Br_{b'}I_{c'} \qquad \text{Formula 1}$$

wherein $0 \leqq a' \leqq 1$, $0 \leqq b' \leqq 1$, $0c' \leqq 1$, $a'+b'+c'=1$, and $c<c'$

DETAILED DESCRIPTION OF THE INVENTION

The surface phase of silver grains herein means the most external phase including the outermost surface phase of a silver halide grain and is a part comprising the outermost surface phase as the first atom phase, the subsequent internal phase as the second atom phase, then followed by the third atom phase, the fourth atom phase and up to the fifth atom phase towared the inner side of the grain (therefore a part up to 14.4 Å from the surface in the case of a cubic silver halide grain). The surface phase of the invention is preferably a phase up to the fourth atom phase, and more preferably a phase up to the third atom phase in the invention. More concretely, the surface phase of the invention has a thickness of not more than 15 Å, more preferably not more than 10 Å, toward the inner part of the grain from the surface phase of the grain.

If the most external phase is thicker than the above, then the desensitization due to the dispersion of the chemically sensitized nucleus and the initial developability drop of the emulsion occur conspicuously.

In the invention, the surface phase must have a higher silver iodide content than the internal phase adjacent thereto.

The silver iodide content of the surface phase is preferably 5 mole % or more, more preferably 10 mole % or more, and most preferably 15 mole % or more.

The internal phase adjacent to the surface phase herein means a phase constituting the outermost phase of silver halide grains except the surface phase.

The internal phase adjacent to the surface phase of silver halide grains of the invention means a phase up to 100 Å, preferably 60 Å, and more preferably 40 Å from the outermost phase of silver halide grains except the surface phase.

The silver iodide content of the internal phase is preferably less than 5 mole % in consideration of developability.

The silver iodide content of the surface of the silver halide grain can be measured according to a method known as XPS method (XPS stands for X-ray Photoelectron Spectroscopy).

For the principle of the XPS method reference can be made to Junichi Aihara et al, 'Denshi-no Bunko' (meaning Electron Spectroscopy), (Kyoritsu Library 16, 1978, Kyoritsu Publishing Co.).

JP O.P.I. No. 44751/1988 describes in detail general measuring methods for photographic silver halide grains.

However, in the XPS method usually used in which the escape depth from a sample of a photoelectron as a measuring probe is about 40 to 50 Å, about 14th to 20th atom phase, for analyzing the halide composition of the silver halide grain surface, the silver iodide content of the phase can be detected where the most external phase having a high silver iodide content disclosed in JP O.P.I. No. 106745/1988 has a thickness of about 50 Å (thickness up to approximately the 20th atom phase, but it is difficult to detect the silver iodide content in the region up to about 10 Å depth from the grain surface like the surface phase of the present invention.

As described by Saijo in Journal of the Society of Photographic Science and Technology of Japan, pp.3-12 (1985), for the composition analysis of the grain surface in the actual silver halide emulsion system performed in the past there was a case where the depth analysis was made according to the XPS method while the grain was subjected to spattering with an inert gas ions.

As Saijo describes, however, it is difficult for such the depth analysis to make the resolution thereof smaller than 20-30 Å, and further the analysis results contain an error of several tens A.

Accordingly, a quantitative analysis of a composition containing the grain surface in the case of a composition different from the internal phase in the region of a depth of about 10 Å from the surface as in the silver halide grain of the invention depends virtually upon the future progress of the analysis. When the silver halide grain is hexahedral, octahedral or tabular, the surface analysis of the grain can be carried out by an angular resolved XPS method, a modification of XPS method generally used. The angular resolved XPS method is described, for example, in C. S. Fadly, Progress in Solid State Chem., 11 (1976), pp.265-343. Although the angular resolved method requires the smoothness of a sample measured, the surface analysis can be conducted in a way as described in KOBUNSHI, 38(4), 1989, pp.281, when the grain is hexahedral, octahedral or tabular. Furthermore, an Auje Electron Spectroscopy (AES) is useful for analyzing the surface of the grain. The silver halide grain of the invention is preferable, when the whole silver iodide content of both the surface phase and a part of the inner phase of the grain is less than 5 mol %, detecting the composition of the grain by XPS method above described. If the whole silver iodide content is not less than 5 mol %, it results in the initial developability drop, the desensitization due to the dispersion of the chemically sensitized nucleus, the increase in fog, and deterioration of graininess.

In the silver halide grain of the invention, as the surface phase becomes thinner, the difference between the silver iodide content of the grain surface and that of the internal phase adjacent thereto measured according to the XPS method becomes reduced, and if the surface layer is extremely thin, the difference may not be detected.

We, the inventors, have found that in this instance, whether a high-silver-iodide-content phase is formed or not on the silver halide grain surface can be confirmed by measuring the silver ion conductivity between the lattices of silver halide grains (hereinafter merely called ion conductivity).

Known as a simplified method of measuring the ion conductivity in the emulsion system is a dielectric loss method.

This is a method in which an AC electric field is applied to a dried silver halide emulsion, its frequency is changed to thereby measure a dielectric loss curve, from which the time constant of the interfacial polarization is found to thereby calculate the ion conductivity.

Since the peak frequency of the dielectric loss (absorption) curve is proportional to the ion conductivity, where the ion conductivities of some silver halide grains are compared relatively, the relative comparison can be made with the peak frequency values regarded as the ion conductivity values as long as the difference in the halide composition and crystal habit between the emulsion grains is not significant.

The silver halide grain's ion conductivity (=interlattice silver ion concentration x charge x mobility) increases in value in the order of silver chloride, silver bromide and silver iodide.

Even in the mixed crystal grain of silver iodobromide, as the silver iodide content rate becomes larger, the ion conductivity increases as described in Journal of the Society of Photographic Science and Technology of Japan, Vol.42, No.2, pp.112-121 (1979).

It is known that the grain having (III) face in a relatively large proportion in its external crystal habit as in octahedral or tetradecahedral regular or tabular crystal grains has two peaks appearing in its dielectric loss curve.

There are various views about the origin of the two peaks, but general interpretation of the two peaks is that one peak on the lower frequency side corresponds to the ion conductivity of the inside of the grain, while the other on the higher frequency side corresponds to that of the grain surface. Accordingly, where the surface phase of the silver halide grain having (111) face in its external crystal habit is as highly iodized as in the invention, it is expected that with the increase in the silver iodide content of the grain surface phase, the ion conductivity of the grain surface increases to thereby shift the peak on the higher frequency side toward still higher frequency side.

When we actually measured the silver halide emulsion grain prepared in the example of the invention, it was confirmed that the peak on the higher frequency side was shifted toward still higher frequency side by treating the grain surface phase to raise its iodide content, whereby a high silver iodide content phase was formed on the grain surface.

In the invention, any method for highly iodizing the surface phase may be used without restriction. For example, an aqueous halide solution or silver iodide fine grains may be added so as to increase the iodide content of the surface phase alone at the time of the grain formation, or after the grain formation an aqueous iodide solution. silver iodide fine grains or high-silver-iodide-content silver halide grains may be added, but for the following reason, it is more preferable to use silver iodide fine grains or high-silver-iodide-content silver halide grains.

That is, in the case of adding an aqueous iodide solution, a halogen ion conversion occurs on the silver halide grain surface due to the difference in solubility between silver iodide, silver bromide and silver chloride, whereby the grain surface is highly iodized.

However, the progress of the conversion reaction is higher than that of the uniformalization of the iodide ion concentration in an emulsion liquid, so that the high-iodide-content phase becomes uneven on the grain surface phase or disproportioned between the grains.

Because this reaction is liable to progress also toward the inside of the grain, it is difficult to control the thickness, for example, it is difficult to raise the iodide content of the surface phase alone so as to obtain the silver halide grain of the invention.

On the other hand, in the case of adding silver iodide fine grains or high-silver-iodide-content silver halide grains, the surface phase is highly iodized through solubilization of the silver halide fine grains and recrystalization on the grain surface.

In this reaction, because of the added silver halide fine grain's solubilizing rate determination, a uniform recrystallization occurs inside the emulsion liquid to thus enable to uniformly increase the iodization of individual grains.

Also, since it is not a rapid reaction unlike the conversion reaction, the iodide content of the grain surface phase can be uniformly raised, and besides, control of the thickness is relatively easier than in the case of adding the aqueous iodide solution. In addition, by using a crystal habit control agent in combination, it is possible to control the position of the high-iodide phase formation.

The addition of the aqueous iodide solution, silver iodide fine grains or high-silver-iodide-content silver halide grains after the grain formation may be performed in any stage after the grain formation.

Namely, any stage may be selected for the addition from among the silver halide emulsion preparation process including the steps of desalting, before, during or after washing following the grain formation: the silver halide emulsion sensitization process including the steps before, during and after chemical sensitization; and the emulsion coating process.

When the addition is made in the process including the steps in desalting, after washing and before chemical sensitization, the use of silver iodide fine grains or high-silver-iodide-content silver halide grains is better for minimizing the change in pAg of the emulsion than the use of the aqueous iodide solution.

The use of the aqueous iodide solution in the above process increases the change in pAg to largely affect the chemical sensitization.

The treatment for the high iodization of the grain surface layer may be performed either at once or in two or more installments.

In the invention, there is no need of covering the entire surface of the grain with the surface phase of the invention: covering at least part of the grain surface with the surface phase is enough for the effect of the invention, but for more remarkable effect of the invention it is necessary to cover preferably not less than 10%, more preferably not less than 20%, and most preferably not less than 30% of the grain surface with the surface phase of the invention. It is also possible to use a crystal habit control agent in combination for raising the iodide content of a specific part alone of the surface phase.

In the invention, the grain structure is not particularly restricted except the requirement for the silver iodide content of the grain surface phase to be higher than that of the phase adjacent thereto, but is more preferably to have a high-silver-iodide-content phase in the inside thereof.

The silver iodide content of the high-silver-iodide-content phase is preferably 15 to 45 mole %, more preferably 20 to 42 mole % and most preferably 25 to 40 mole %.

The silver halide grain of a structure having a high-silver-iodide-content phase in the inside thereof is one having a high-silver-iodide-content phase covered with a low-iodide-silver-content phase or silver chloride phase whose silver iodide content is lower than that thereof.

In this instance, the above low-silver-iodide-content phase can be constituted so as to form the most external phase in the following meaning:

Namely, the average silver iodide content of the above silver-iodide-content phase whose iodide content is lower than that of the high-silver-iodide-content phase in the case of forming the outermost phase (the phase positioned in the outermost part of the grain except the surface phase of silver halide grains of the invention) is preferably not more than 6 mole %, and more preferably 0 to 4 mole %. And, a silver iodide-containing phase as an intermediate phase may be present between the most external phase and the high-silver-iodide-content phase.

The silver iodide content of the intermediate phase is preferably 10 to 35 mole % and more preferably 12 to 30 mole %.

The difference in the silver iodide content between the outermost phase and the intermediate phase and that between the intermediate phase and the inside high-silver-iodide-content phase are preferably each not less than 6 mole % and more preferably not less than 10 mole %.

In the above embodiment, still other silver halide phases may be present in the central part of the inside high-silver-iodide-content phase, between the inside high-silver-iodide-content phase and the intermediate phase, and between the intermediate phase and the outermost phase.

The volume of the outermost phase accounts for preferably 4 to 70%, more preferably 10 to 50% of the whole grain. The volume of the high-silver-iodide-content phase accounts for 10 to 80%, more preferably 20 to 50%, and most preferably 20 to 45% of the whole grain. The volume of the intermediate phase accounts for preferably 5 to 70% and more preferably 20 to 55% of the whole grain.

These phases each may be a single phase of a uniform composition, a phase comprising a plurality of phases having uniform and stepwise changing compositions or a continuous phase whose composition continuously changes in an arbitrary phase, or a combination of these phases.

Another embodiment of the silver halide emulsion of the invention is one in which the silver iodide present locally inside the grain does not form a substantially uniform phase but the silver iodide content continuously changes from the central part of the grain toward the outside. In this instance, it is preferably for the grain to have the silver iodide structure disclosed in Takada et al, Japanese Patent Application No. 344732/1989.

Even in this instance, the silver iodide content of the outermost phase of the grain is preferably less than 6 mole % and more preferably 0 to 4 mole %.

The silver halide emulsion of the invention comprises silver iodobromide whose average silver iodide content is preferably 4 to 20 mole %, and more preferably 5 to 15 mole %.

The silver halide emulsion of the invention contains silver iodide, but may arbitrarily contain other silver halide components such as silver chloride within limits not to impair the effect of the invention.

The silver halide emulsion of the invention preferably satisfies at least one of the following conditions (1) to (4):

(1 ) The emulsion should satisfy a relation of $J_1 > J_2$, wherein $J_1$ is the average silver iodide content found according to an X-ray fluorometry, and $J_2$ is the silver iodide content of the grain surface found by a XPS method, wherein the XPS method is explained as follows:

The emulsion is subjected to a pretreatment prior to the measurement according to the XPS method. Firstly, a pronase solution is added to the emulsion. The emulsion is stirred at 40° C. for an hour for gelatin decomposition, centrifugalized to have the emulsion grain precipitated, subjected to decantation, and then to the emulsion is added a pronase aqueous solution to repeat the gelatin decomposition under the above condition. After repeating the centrifugal treatment and decantation, the emulsion grains are redispersed in distilled water, then centrifugalized and then decanted. After repeating this washing procedure three times, the emulsion grains are redispersed in ethanol, and the dispersion is coated thin over a mirror-like polished silicone wafer to be used as a sample for measurement.

The XPS measurement is carried out by using, e.g., ESCA/SAM 560 instrument, manufactured by PHI Co., under the conditions of Mg-Kα rays as an excitation X-ray, an X-ray source voltage of 15KV, an X-ray source current of 40 mA, and a pass energy of 50 eV.

In order to find the surface halide composition, Ag 3d, Br 3d and I 3d 3/2 electrons are detected. The calculation of the composition ratio is carried out according to the relative speed coefficient method by using the respective peaks' integral strengths. As the Ag 3d, Br 3d, I 3d 3/2 relative speed coefficients, 5.10, 0.81 and 4.592, respectively, are used, whereby the composition ratio is given in atom percentage.

(2) The emulsion should satisfy a relation of $J_1 > J_3$, wherein $J_1$ is the average silver iodide content found according to the X-ray fluorometry, and $J_3$ is the average silver iodide content value obtained by measuring on the silver halide crystal 80% away from the central part in the diameter direction of the silver halide grain by using a XMA method, wherein the XMA stands for X-ray Micro Analysis and the method is explained as follows:

The silver halide grains are dispersed in a grid for observation through an electron microscope equipped with an energy dispersion-type X-ray analyzer, under a liquid nitrogen cooling condition the magnification of the device is so set as to have one grain come in the CRT field of view, and for a given period of time, the Ag Lα and I Lα rays strengths are integrated. A calibration curve prepared beforehand for the I Lα/Ag Lα strength ratio is used for calculation of the silver iodide content.

(3) When subjected to X-ray diffraction analysis, the emulsion grain crystal structure should be such that at the maximum peak height×0.113 of the (420)X-ray diffraction signal to CuKα rays as a radiation source, the signal be continuously present over a diffraction angle of more than 1.5 degrees, preferably at the signal's maximum peak height $\times 0.15$, the signal be continuously present over a diffraction angle of more than degrees, more preferably the diffraction angle where the signal is present be more than 1.8 degrees, and most preferably more than 2.0 degrees.

That the signal is present means that in the maximum peak height $\times 0.113$ or $\times 0.15$, the signal has a strength that is more than the height.

(4) The above (420)X-ray diffraction signal to CuKα rays as a radiation source should have two or three peaks, particularly preferably three peaks.

The X-ray diffraction analysis known as a method for examining the structure of silver halide crystals is explained below:

X-ray radiation sources having various characteristics may be used for the analysis. Particularly, a CuKα-ray, in which Cu is used as a target, is most widely used.

Silver iodobromide has a rock salt structure, of which the signal observed at a CuKα ray (420) diffraction angle of $2\theta$ 71 to 74 degrees is relatively strong and has a good resolution, so that it is suitable for crystal structure examination.

In the X-ray diffraction measurement of a photographic emulsion, it is necessary to remove the gelatin from the emulsion, mix it with a reference sample such as silicon, and then perform the measurement in accordance with a powder method.

For the measurement reference can be made to Kiso-Bunseki Kagaku Koza 24 (Chemical Course for Basic Analysis 24), published by Kyoritsu Publishing Co.

In the emulsion of the invention, the silver iodide content of the individual grains is preferably as much uniform as possible. When the average silver iodide content of the individual silver halide grains is measured according to the XMA method, the relative standard deviation of the measured values is preferably not more than 20%, more preferably not more than 15% and most preferably not more than 12%.

The above relative standard deviation is defined by:

$$\frac{\text{Standard deviation of silver iodide content values of at leas 100 emulsions}}{\text{Average silver iodide content}} \times 100$$

In the silver halide grains of the invention, the crystal habit thereof is not restricted.

The silver halide grain of the invention may be in the form of a regular crystal such as a cubic, octahedral, dodecahedral, tetradecahedral or tetracosahedral crystal: a tabular or twin crystal; an indeterminate form such as a poteto-like form; or may be a combination of these crystal forms.

In the case of tabular twin crystal grains, the totalled areas of grains having the proportion of the diameter of a circle equivalent in the area to the grain's projection image to the thickness of the grain of 1 to 20 account for preferably not less than 60% of the whole projection field of view, and the proportion is preferably not less than 1.2 and less than 8.0, and more preferably not less than 1.5 and less than 5.0.

The silver halide emulsion of the invention is preferably a monodispersed silver halide emulsion.

In the invention, the monodispersed emulsion is one in which the weight of the silver halide included in the grain diameter range of the average grain diameter $\bar{d} \pm 20\%$ accounts for preferably not less than 70%, more preferably not less than 80% and most preferably not less than 90% of the whole silver halide weight, wherein the average grain diameter $\bar{d}$ is defined as the grain diameter di at the time when the product of $n_i \times d_i^3$ is maximum, wherein $d_i$ is the diameter of a grain, and $n_i$ is a frequency of the grains having a diameter $d_i$. (three significant figures; round to three decimal places).

The grain diameter herein means the diameter of a circle equivalent in the area to the grain projection image.

The grain diameter can be obtained in the manner that the grain is projected in the 10,000 to 50,000-fold magnification through an electron microscope, and the diameter of the magnified grain image on the print derived therefrom or the area of the projection image of the grain is measured, provided that the number of the grains to be measured should be more than 1000 at random.

The particularly preferred highly monodispersed emulsion of the invention has a grain diameter distribution width of preferably not more than 20%, and more preferably not more than 15%, provided that the distribution width is defined by $$\frac{\text{Grain diameter's standard deviation}}{\text{Average grain diameter}} \times 100 = \text{distribution width}$$

Herein the diameter measuring method complies with the previously stated method, and the average grain diameter is an arithmetic mean:

$$\text{Average diameter} = \frac{d_i\, n_i}{n_i}$$

The average grain diameter of the silver halide emulsion of the invention is preferably 0.1 μm to 10.0 μm, more preferably 0.2 μm to 5.0 μm, and most preferably 0.3 μm to 3.0 μm.

The monodispersed regular crystal emulsion may be produced by making reference to the methods disclosed in JP O.P.I. Nos. 177535/1984, 138538/1985, 52238/11984, 143331/1985, 55726/11985, 258536/1985 and 14636/1986.

The monodispersed twin crystal emulsion may be produced by making reference to the method for growing a spherical seed emulsion disclosed in JP O.P.I. No. 14636/1986.

The silver halide grains of the invention may be prepared by various means, but the effect of the invention may be made remarkable when prepared in accordance with the following method [I] or [II]:

Method [I]

For preparing the silver halide grains of the invention containing at least iodine like silver iodobromide or silver chloroiodobromide, in the grain growth thereof may be added iodine ions in the form of an ion solution such as a potassium iodide solution, or may be added in the form of grains having a smaller solubility product than the silver halide grains in growth, but more preferably in the form of silver halide grains having a smaller solubility product.

A preferred embodiment of preparing the silver halide grains of the invention is such that the growth of the silver halide grains of the invention, during at least a temporary period in the growing process thereof, is made in the presence of other silver halide fine grains (hereinafter called AgX grains (2)) having a solubility product equal to or smaller than that of said growing silver halide grains of the invention the description of the process of grain growth).

That the solubility product is equal or smaller means that the solubility product of AgX grains (2) is equal to or smaller than that of AgX grains (1). The solubility product herein has the same meaning as in ordinary chemical interpretation.

In such the embodiment, the growth of AgX grains (1) is carried out, for at least a temporary period in the growing process thereof, in the presence of AgX grains (2) having a solubility product equal to or smaller than that of AgX grains (1). The AgX grains (2) may be present until the completion of supply of the elements (halogen ion solution and silver ion solution) for growing AgX grains (1).

The average grain diameter of AgX grains (2) is generally smaller than that of AgX grains (1), but may be larger as the case may be. The AgX grains (2) are not substantially sensitive. The average grain diameter of AgX grains (2) is preferably 0.001 to 0.7 μm, more preferably 0.01 to 0.5 μm, and most preferably 0.1 to 0.01 μm.

At least by the time of completion of the growth of AgX grains (1) the AgX grains (2) are preferably present in the suspension system (hereinafter called mother liquid) for the preparation of AgX grains (1).

When silver halide seed grains are used, the AgX grains (2) may be present in the above mother liquid prior to adding the seed grains, may be added to the mother liquid containing the seed grains prior to adding grain growing compositions, may be added in the midst of adding the grain growing elements, or may be added in two or more installments within the above adding period.

Where the grain growth after the silver halide nucleus formation is performed without using seed grains, the AgX grains (2) are preferably added after the nucleus formation, before or in the midst of the addition of the grain growing elements, or in two or more installments.

Both AgX grains (2) and grain growing elements may be en bloc added at a time, continuously or intermittently.

The AgX grains (2) and the grain growing elements are preferably added at a speed suitable for the grain growth to the mother liquid under controlled pH, pAg and temperature conditions by a multi-jet method such as the double-jet method.

The AgX grains (2) and the silver halide seed grains may be prepared inside the mother liquid or may, after being prepared outside the mother liquid, be added to the mother liquid.

The water-soluble silver salt solution for use in preparation of the AgX grains (2) is preferably an ammoniacal silver salt solution.

The halide composition of the AgX grains (2), where the AgX grains (1) is, e.g., silver iodobromide, is preferably silver iodide or silver iodobromide having a higher iodide content than the growing silver iodobromide grains; for example, if the AgX grains (I) is silver chlorobromide, the halide composition is preferably silver bromide or silver chlorobromide having a higher bromide content than the growing silver chlorobromide grains. When the AgX grains (1) is silver iodobromide, the AgX grain (2) is most preferably silver iodide.

Where the AgX grains (1) is silver iodobromide or silver chloroiodobromide, all the iodide used in the growth of grains is preferably supplied as the AgX grains (2), but a part thereof may be supplied in the form of an aqueous halide solution within limits not to impair the effect of the invention.

Method [II]

This is a method for preparing a silver halide photographic emulsion, in which, in order to obtain the silver halide grains of the invention, a water-soluble silver salt solution and a water-soluble halide solution are supplied in the presence of a protective colloid. The method is carried out in the following processes (a) to (c):

(a) A process for producing nucleus grains in which pBr of the mother liquid is maintained 2.0 to −0.7 during more than ½ of the period from the initial stage of producing the precipitate of silver halide having 0 to 5 mole % silver iodide content:

(b) a seed grains-forming process in which the mother liquid contains a silver halide solvent in an amount of $10^{-5}$ to 2.0 moles per mole of silver halide to form substantially monodispersed spherical twin silver halide seed grains; and (c) a process for growing the seed grains by adding thereto a water-soluble silver salt solution and a water-soluble halide solution and/or silver halide fine grains.

The mother liquid mentioned above is a liquid (also containing a silver halide emulsion) provided for the process from preparation of the silver halide emulsion to obtaining a complete photographic emulsion.

The silver halide grains formed in the foregoing nucleus grains-producing process are twin grains comprised of silver iodobromide containing 0 to 5 mole % silver iodide.

The twin grain means a silver halide crystal having one or more twin planes within one grain. Classification of twin forms are described in detail in, Klein and Moiser, a report 'Photographische Korrespondenz' Vol.99, p.99, and Vol.100, p.57. The two or more twin planes of a twin crystal may or may not be parallel to each other, and the external wall of the crystal may comprise {111} plane, {100} plane or combination of these planes.

The silver halide grains of the invention are more preferably manufactured by a method described below.

The silver halide grains (halogen composition of the outermost phase of the grains: $AgCl_aBr_bI_c$) as the parent to which fine-grained silver halide is added are hereinafter called mother grains. The mother grains represent silver halide grains without the surface phase of the invention.

Firstly, a preferred embodiment of the mother grains are explained.

The total silver halide composition of the mother grains is allowed to be any composition as long as it is represented by $AgCl_aBr_bI_c$, wherein $0 \leqq a \leqq 1$, $0 \leqq b \leqq 1$, $0 \leqq c \leqq 0.2$ and $a+b+c=1$, and preferably comprises silver chloride. silver chlorobromide, silver bromide, silver iodobromide and silver chloroiodobromide. The particularly preferred total halide composition of the mother grains comprises silver chlorobromide, silver iodobromide and silver chloroiodobromide.

Where the mother grains used in the invention is silver chlorobromide, the bromine content of the total grains is preferably 15 to 99 mole %, and the surface halide composition in terms of the bromine content is preferably 0 to 80 mole %, and more preferably 10 to 60 mole %.

The silver chlorobromide mother grain size is preferably not less than 0.3 μm, and most preferably 0.5 to 2.5 μm. The grain may be in the regular form or irregular form, but regarding the grain diameter distribution thereof, the mother grain emulsion is preferably a monodispersed silver halide emulsion.

Subsequently, the case where the mother grains are silver iodobromide or silver chloroiodobromide grains is described. The grain size of the mother grains in this instance preferably has a diameter of from 0.3 to 3.0 μm, and most preferably 0.5 to 2.5 μm. As for the grain diameter distribution, the mother grain emulsion is preferably a monodispersed silver halide emulsion.

The average silver iodide content of the silver iodobromide or silver chloroiodobromide mother grains is preferably 0.5 to 20 mole % and more preferably 1.0 to 15 mole %. Particularly, the effect of the invention is exhibited to the utmost when the mother grains are silver iodobromide grains having an average silver iodide content of 2.0 to 15 mole %.

Where the mother grains of the invention are silver iodobromide or silver chloroiodobromide grains, the silver halide emulsion of the invention has a high-silver-iodide-content phase inside the grain thereof. The silver iodide content of the high-silver-iodide-content phase is preferably 15 to 45 mole %, more preferably 20 to 42 mole %, and most preferably 25 to 40 mole %.

In the silver halide grain having the high-silver-iodide-content phase inside the grain of the invention, the high-silver-iodide-content phase is one covered with a low-silver-iodide-content phase.

The average silver iodide content of the low-silver-iodide-content phase whose silver iodide content is lower than that of the high-silver-iodide-content phase which constitutes the most external phase is preferably not more than 6 mole %, and more preferably 0 to 4 mole %. A silver iodide-containing phase (intermediate phase) may be present between the most external phase and the high-silver-iodide-content phase.

The silver iodide content of the intermediate phase is preferably 10 to 35 mole %, and more preferably 12 to 30 mole %.

The difference in the silver iodide content between the most external phase and the intermediate phase and between the intermediate phase and the inside high-silver-iodide-content phase is preferably not less than 6 mole %, and more preferably not less than 10 mole %.

In the above embodiment, still other silver halide phases may be present in the central part of the high-silver-iodide-content phase, between the high-silver-iodide-content phase and the intermediate phase and between the intermediate phase and the most external phase.

The volume of the most external phase accounts for preferably 4 to 70% and more preferably 10 to 50% of the whole grain. The volume of the high-silver-halide-content phase accounts for preferably 10 to 80%, more preferably 20 to 50%, and most preferably 20 to 45% of the whole grain. The volume of the intermediate phase accounts for preferably 5 to 60%, and more preferably 20 to 55% of the whole grain.

These phases each may be a single phase having a uniform composition, a group of a plurality of phases each having a uniform composition or stepwise changing compositions, or a continuous phase whose composition continuously changes in an arbitrary phase, or a combination of these phases.

Another embodiment of the silver halide emulsion of the invention in the case where the mother grain of the invention is silver iodobromide or silver chloroiodobromide is such that the silver iodide present locally inside the grain does not form a substantially uniform phase but the silver iodide content continuously changes from the central part toward the outside of the grain. In this instance, the silver iodide content of the grain preferably changes monotonously from the maximum content point toward the outside of the grain.

The silver iodide content at the maximum point thereof is preferably 15 to 45 mole %, and more preferably 25 to 40 mole %.

The silver iodide content of the silver iodobromide grain surface phase is preferably not more than 6 mole %, and more preferably 0 to 4 mole %.

The mother grain crystal of the invention may be a regular crystal such as a cubic, octahedral or tetradecahedral crystal: a tabular twin; or a mixture of these crystals.

Where the mother grain is a tabular twin, the total area of the grains having a proportion of the diameter of a circle equivalent in the area to the projection grain image to the thickness thereof of 1 to 20 accounts for preferably not less than 60% of the whole projection field of view, and the proportion is preferably not less than 1.2 and less than 8.0, and more preferably not less than 1.5 and less than 5.0.

Next, the fine-grained silver halide used in the invention is explained. The grain size of the fine-grained silver halide is preferably not more than 0.2 μm and more preferably 0.02 to 0.1 μm. The fine-grained silver halide composition is represented by $AgCl_a,Br_b,I_c'$, wherein $0 \leqq a' \leqq 1$, $0 \leqq b' \leqq 1$, $0 \leqq c' \leqq 1$, and $a'+b'+c'=1$.

The preferred combinations of the halide composition of the outermost phase of the mother grain and that of the fine-grained silver halide are:

(1) Where the mother grain surface contains iodine, i.e., $c \neq 0$, the combination is preferably $0 \leqq c \leqq 0.05$ and $c' \leqq 0.112$, and more preferably $0 \leqq c \leqq 0.04$ and $c'=1$.

(2) Where the surface of the mother grain comprises silver chlorobromide containing not less than 40 mole % bromine, i.e., $c=0$ and $b \leqq 0.4$. the combination is preferably with the fine-grained silver halide of $c' \leqq 0.12$, and more preferably $c'=1$.

(3) Where the surface of the mother grain comprises silver chlorobromide containing less than 40 mole % bromine, i.e.. $c=0$ and $b<0.4$, the combination is preferably with the fine-grained silver halide of $c' \leqq 0.112$.

The particularly preferred among the above combinations is the combination where the fine-grained silver halide of $c'=1$ or $b'=1$ is used.

As for the fine-grained silver halide of $c'=1$, cubic-system γ-AgI and hexagonal-system β-AgI are generally known, but the fine-grained AgI used in the invention may be either one of the crystal systems, and may also be a mixture thereof. In order to determine the mother grain surface composition, the previously mentioned X-ray photoelectric spectral analysis may be used.

Subsequently, an adding amount of the fine-grained silver halide is explained.

The adding amount of the fine-grained silver halide, when the average grain diameter of the mother grain is designated as d(μm), is preferably not more than 1/100d mole, more preferably 1/20,000d to 1/300d mole, and most preferably 1/1000d to 1/500d mole per mole of the mother grain.

The fine-grained silver halide used in the invention is preferably well-monodispersed, and preferably prepared under controlled temperature, pH and pAg conditions.

The fine-grained silver halide of the invention may be added at a stage of the course from a chemical ripening stage to immediately before a coating stage, but preferably at the chemical ripening stage. The chemical ripening stage herein is the process from a point of time of completion of the physical ripening and desalting procedure through the addition of a chemical sensitizer for chemical ripening to the point of time of stopping the chemical ripening. The stopping of the chemical ripening may be carried out by lowering the ripening temperature, lowering pH or using a chemical ripening stopping agent, but in consideration of the stability of the emulsion, the use of a chemical ripening stopping agent is preferred. Examples of the chemical ripening stopping agent include halides such as potassium bromide and sodium chloride; and organic compounds known as antifoggants or stabilizers, such as 4-hydroxy-6-methyl-1,3,3a,7-tetrazaindene. These may be used alone or in combination.

The fine-grained silver halide of the invention may be added intermittently in several installments, and after the addition of the fine-grained silver halide, other chemically ripened emulsion may also be added.

The temperature of the mother grain emulsion at the time of adding the fine-grained silver halide thereto is preferably in the range of 30° to 80° C., and more preferably 40° to 65° C.

The present invention is preferably practiced under a condition where the fine-grained silver halide added vanishes partly or wholy during the period of time from the addition to immediately before the coating, and more preferably not less than 20% of the added fine-grained silver halide vanishes before the coating.

The quantitative analysis of the vanishing amount can be made in the manner that the fine-grained silver halide-added emulsion or coating liquid is centrifugalized under an appropriate condition, the supernatant liquid is subjected to an absorption spectral measurement, and then the measured absorption spectrum is compared with the absorption spectrum of a known concentration-having fine-grained silver halide liquid.

As the silver halide emulsion of the invention there may be used those disclosed in Research Disclosure 308119 (hereinafter called RD308119). The relevant items and pages in the RD are as follows:

| Item | Page |
|---|---|
| Producing method | 994 E |
| Epitaxial metal content | 994 D |
| Monodisperse | 995 I-F |
| Solvent addition | 995 I-F |
| Latent image forming position: | |
| Surface | 995 I-G |
| Inside | 995 I-G |
| Light-sensitive material applied: | |
| Negative | |
| Positive (containing internally fogged grains) | 995 I-I |
| Desilvering | 995 II-A |

When preparing a different emulsion which is used as needed in combination in constituting the emulsion or light-sensitive material of the invention, a non-gelatin substance adsorbable to the silver halide grains may be added. Useful examples of such the adsorbable substance include compounds known as antifoggrant or stabilizers or heavy metal ions. Detailed examples of the above adsorbable substance are described in JP O.P.I. No. 7040/1987.

The addition of at least one of the antifoggants or stabilizers as the adsorbable substance to the seed emulsion at the time of its preparation is advantageous for reducing the fog and improving the preservability of the emulsion.

Preferred among the antifoggrants and stabilizers are heterocyclic mercapto compounds and/or azaindene compounds. More useful examples of the heterocylic mercapto compounds and azaindene compounds are described in detail in JP O.P.I. No. 41848/1988.

The adding amount of the above heterocyclic mercapto compound and azaindene compound, although not restricted, is preferably $1\times10^{-5}$ to $3\times10^{-2}$ mole, and more preferably $5\times10^{-5}$ to $3\times10^{-3}$ mole per mole of silver halide. An appropriate amount is discretionarily selected from the above amount range according to the silver halide preparing conditions, the average grain diameter of the silver halide grains and the kind of the above compounds used.

The finished emulsion provided with prescribed grain conditions may, after the silver halide grain formation, be desalted according to a known method. For the desalting there may be used the aggregation gelatin agent for desalting seed grains as described in JP O.P.I. Nos. 243936/1988 and 185549/1989, a noodle washing method for gelling gelatin, or a coagulation method which utilizes a multivalent anionic inorganic salt such as sodium sulfate, anionic surfactant or anionic polymer such as polystyrenesulfonic acid.

In general, the desalted silver halide grains are redispersed in gelatin, whereby an emulsion is prepared.

The light-sensitive material of the invention may comprise different other silver halide grains in combination with the silver halide grains of the invention.

The combinedly used silver halide grains may have any grain size distribution; i.e., may be of either a polydispersed emulsion having a wider grain size distribution or monodispersed emulsion having a narrower grain size distribution.

The light-sensitive material of the invention comprises silver halide emulsion layers, at least one of which layers contains the silver halide grains of the invention, but the at least one layer may also contain different silver halide grains other than the silver halide grains of the invention.

In this instance, the emulsion containing the silver halide grains of the invention accounts for preferably not less than 20% by weight, and more preferably not less than 40% by weight of the whole emulsions.

Where the light-sensitive material of the invention comprises two or more silver halide emulsion layers, there may be present an emulsion layer containing only silver halide grains other than the silver halide grains of the invention.

In this instance, the emulsion of the invention accounts for preferably 10% by weight and more preferably 20% by weight of the whole silver halide emulsions used in all the light-sensitive layers constituting the light-sensitive material.

The silver halide grains of the invention may be spectrally sensitized with the spectral sensitizers described in the following Research Disclosure numbers and pages, or may be spectrally sensitized in combination with other spectral sensitizers.

No.17643, p.23-24

No.187116, p.648-64

No.308119, p.996, IV-A-A, B, C, D; H, I, J

The effect of the invention becomes remarkable when the silver halide grains of the invention are spectrally sensitized; especially when spectrally sensitized by using trimethine and/or monomethine cyanine dyes alone or in combination with other spectral sensitizers. Other silver halide grains different from the silver halide grains of the invention, which may as needed be used in the light-sensitive material of the invention, may be discretionarily optically sensitized to a desired wavelength region. Any method for the optical sensitization may be used without restriction; for example, the optical sensitization may be carried out by using optical sensitizers including cyanine dyes such as zeromethine dyes, monomethine dyes, dimethine dyes, trimethine dyes and merocyanine dyes. These dyes may be used alone or in combination. Combination of sensitizing dyes is frequently used for the purpose of supersensitization. Besides the sensitizing dyes, the emulsion may also contain a substance showing supersensitization which in itself has no spectral sensitization effect and does not substantially absorb visible rays. These techniques are described in U.S. Pat. Nos. 2,688,545, 2,912,529, 3,397,060, 3,615,635 and 3,628,964, British Patent Nos. 1,195,302, 1,242,588 and 1,293,862, West German OLS Patent Nos. 2,030,326 and 2,112,780, Japanese Patent Examined Publication No. 14030/1968, and RD Vol.176, No.17643 (December 1978) p.23 IV-J. Appropriate sensitizers may be discretionarily selected according to the wavelength to which the light-sensitive material is sensitive, the sensitivity, purpose and use of the light-sensitive material.

The emulsion of the invention may be chemically sensitized with various chemical sensitizers. Chemical sensitizers include chalcogen sensitizers such as sulfur sensitizers, selenium sensitizers and tellurium sensitizers. Preferred for photographic use are sulfur sensitizers and selenium sensitizers. As the sulfur sensitizer there may be used known compounds including thiosulfates, allylthiocarbamide, thiourea, allylisothiocyanate, cystine, p-toluenethiosulfonates and rhodanine. In addition, there may also be used the sulfur sensitizers described in U.S. Pat. Nos. 1,574,944, 2,410,689, 2,278,947, 2,728,668, 3,501,313 and 3,656,955, West German OLS Patent No. 1,422,869, JP O.P.I. Nos. 24937/1981 and 45016/1980. The sulfur sensitizer is added in an amount sufficient for effectively increasing the sensitivity of the emulsion. The sufficient amount changes in a considerable range depending upon pH, temperature, silver halide grain sizes, and the like, but as a standard, the amount is preferably about $10^{-7}$ to about $10^{-1}$ mole per mole of silver halide.

Examples of the selenium sensitizer include isoselenocyanates such as allylisoselenocyanate, selenoureas, selenoketones, selenoamides, selenocarboxylic acids and esters thereof, selenophosphates, and selenides such as diethyl selenide, diethyl selenide. Concrete examples of these compounds are described in U.S. Pat. Nos. 1,574,944, 1,602,592 and 1,623,499.

The adding amount of the selenium sensitizer varies in a considerable range as in the foregoing sulfur sensitizers, but as a standard, is preferably about $10^{-7}$ mole to about $10^{-1}$ mole per mole of silver halide.

In the invention, there may be used gold sensitizers including various gold compounds of monovalent or trivalent gold. Typical examples thereof include chloroauric acids, potassium chloroaurate, auric trichloride, potassium auric thiocyanate, potassium iodoaurate, tetracyanoauric acid, ammonium aurothiocyanate and pyridyltrichlorogold.

The adding amount of the gold sensitizer differs according to various conditions, but as a standard, is preferably about $10^{-7}$ to about $10^{-1}$ mole per mole of silver halide.

The gold sensitizer may be added simultaneously with the addition of the sulfur sensitizer or selenium sensitizer, or in the midst of or after the sensitization by the sulfur or selenium sensitizer.

When subjected to the sulfur sensitization, selenium sensitization and gold sensitization, the emulsion of the invention preferably has a pAg of 5.0 to 10.0 and a pH of 5.0 to 9.0.

In the chemical sensitization of the emulsion of the invention, there may be combinedly used other sensitization method which uses salts or complex salts of other noble metals such as platinum, palladium, iridium and rhodium.

Further useful compounds for splitting gold ions from gold-gelatinate and accelerating the adsorption of the gold ion to the silver halide grains are complex salts of rhodium, palladium, iridium and platinum. Particular compounds are $(NH_4)_2[PtCl_4]$, $(NH_4)_2PdCl_4]$, $K_3[IrBr_4)$ and $(NH_4)_3[RhCl_4]_{12}H_2O$. Of these the most preferred is ammonium tetrachloropalladate $(NH_4)_2[PdCl_4]$. The compound is added preferably in a molar amount of 10 to 100 times that of the gold sensitizer.

The above compound may be added in the commencement of, during or after the chemical sensitization process, preferably during the progress of the chemical sensitization, and more preferably simultaneously with, before or after the addition of the gold sensitizer.

In the invention, it is also possible to combinedly use a reduction sensitizer. Any reduction sensitizers may be used without restriction, but examples of the reduction sensitizer include stannous chloride. thiourea dioxide, hydrazine derivatives, and polyamines.

The reduction sensitization may be performed during the growing period of the silver halide grains, but preferably after the chalcogen sensitization, gold sensitization and noble metal sensitization.

Further, in the chemical sensitization, a nitrogen-containing heterocyclic compound, particularly azaindene ring-having compound, may be present together.

The adding amount of the nitrogen-containing heterocyclic compound changes in a considerable range depending on the emulsion grain size, composition and chemical sensitization conditions, but the compound is added preferably in an amount necessary for the formation of a single molecule layer to 10 molecules layer on the silver halide grain surface. This adding amount, however, may be varied by controlling the adsorption equilibrium condition according to changes in the pH and/or temperature at the time of sensitization. Also, when two or more kinds of the above compound are used, the whole compounds may be added so that the total amount thereof is in the above range.

To the emulsion the above compound may be added in the form of a solution prepared by being dissolved in a solvent not affecting the emulsion, such as water or an aqueous alkaline solution. The compound is added preferably before or simultaneously with the addition of the sulfur sensitizer or selenium sensitizer. The addition of the gold sensitizer is made preferably during the progress of or after the sulfur sensitizer or selenium sensitizer.

The silver halide grains may be optically sensitized to a desired wavelength region by using sensitizing dyes.

To the light-sensitive material of the invention may be added various additives. Useful examples of the additives are the known photographic additives described in the relevant RD Nos. Items and sections listed in the following table.

TABLE

| Item | RD308119 page, section | RD17643 page | RD18716 page |
|---|---|---|---|
| Anti-color turbidity agents | 1002 VII-1 | 25 | 650 |
| Dye image stabilizers | 1002 VII-J | 25 | |
| Bleaching agents | 998 V | 24 | |
| Ultraviolet absorbing agents | 1003 VIIIC, XIIIC | 25-26 | |
| Light absorbing agents | 1003 VIII | 25-26 | |
| Light scattering agents | 1003 VIII | | |
| Filter dyes | 1003 VIII | 25-26 | |
| Binders | 1003 XI | 26 | 651 |
| Antistatic agents | 1006 XIII | 27 | 650 |
| Hardeners | 1004 X | 26 | 651 |
| Plasticizers | 1006 XII | 27 | 650 |
| Lubricants | 1006 XII | 27 | 650 |
| Activators, coating aids | 1005 XI | 26-27 | 650 |
| Matting agents | 1007 XVI | | |
| Developers (contained in light-sensitive materials) | 1011 XXB | | |

In the invention, various couplers may be used, examples of which are disclosed in the above Research Disclosures, in which the relevant items to the invention are listed below:

| Item | RD308119, page | RD17643 |
|---|---|---|
| Yellow couplers | 1001 VII-D | VII C-G |
| Magenta couplers | 1001 VII-d | VII C-G |
| Cyan couplers | 1001 VII-D | VII C-G |
| Colored couplers | 1002 VII-G | VII G |
| DIR couplers | 1001 VII-F | VII F |
| BAR couplers | 1002 VII-F | |
| Other useful residue-releasing couplers | 1001 VII-F | |
| Alkali-soluble couplers | 1001 VII-E | |

The additives used in the invention may be added according to the dispersing method described in RD308119.

In the invention, the materials described in RD17645, p.28, RD18716, p.647-648 and RD309119, XVII, may be used as the support of the light-sensitive material of the invention.

The light-sensitive material of the invention may have auxiliary layers such as the filter layer and intermediate layer described in the aforementioned RD308119 VII-K.

The light-sensitive material of the invention may have various layer structures such as the normal layer structure, inverted layer structure and unit structure described in RD-308119 VII-K.

The invention may be applied to various color light-sensitive materials such as movie color negative films, slide or TV color reversal films, color photographic papers, color positive films and color reversal papers.

The light-sensitive material of the invention may be processed in accordance with the usual procedures described in RD17643, p.28-29, RD1876, p.615, and RD308119, X IX.

EXAMPLES

Preparation of Seed Emulsion

A silver iodobromide emulsion containing 2.0 mole % silver iodide was prepared by a controlled double-jet method under conditions of 40° C., pH 8.0 and pAg 9.0, and then washed to remove the excessive salt therefrom.

The obtained grains had an average grain diameter of 0.335 μm and a grain diameter distribution of 12.5%.

This emulsion was used as a seed emulsion.

Preparation of Fine-Grained Silver Iodide Emulsion

To a 5% by weight gelatin aqueous solution in a reactor, with stirring, were added simultaneously in 30 minutes at a constant rate one mole of silver nitrate and potassium iodide, using a 3.5N silver nitrate aqueous solution and a 3.5N potassium iodide aqueous solution.

In the course of the addition, pAg was maintained at 13.5 by the usual pAg control means.

The obtained silver iodide grains were a mixture of β-AgI and γ-AgI having an average grain diameter of 0.06 μm.

This emulsion contains silver equivalent to 400 g of silver nitrate. This was designated as a fine-grained silver iodide emulsion. The completed weight of the emulsion was 4178 g.

COMPARATIVE EXAMPLE 1

Preparation of Comparative Emulsion Em-A

A comparative silver halide emulsion was prepared in accordance with the method described in JP O.P.I. No. 245151/1986 by using the following six different aqueous solutions and the seed solution.

| | |
|---|---|
| Aqueous solution a-1 | |
| Gelatin | 51.93 g |
| 10% methanol solution of the following Compound I | 30.0 ml |
| 28% ammonia water | 88.0 ml |
| 4-Hydroxy-6-methyl-1,3,3a,7-tetrazaindene | 300 mg |
| 56% acetic acid | 41.0 ml |
| Water to make 5827 ml. | |
| Compound I | |

$$HO(CH_2CH_2O)_m(\overset{\overset{CH_3}{|}}{C}HCH_2O)_{17}(CH_2CH_2O)_nH$$

(Average molecular weight = 1300)

| | |
|---|---|
| Solution a-2 | |
| $AgNO_3$ | 1227 g |
| 28% ammonia water | 1042 ml |
| Water to make 2148 ml. | |
| Solution a-3 | |
| Gelatin | 40 g |
| KBr | 774.7 g |
| KI | 81.34 g |
| 4-Hydroxy-6-methyl-1,3,3a,7-tetrazaindene | 2.06 g |
| Water to make 2 liters | |
| Solution a-4 | |
| $AgNO_3$ | 453.2 g |
| 28% ammonial water | 369.7 ml |
| Water to make 2668 ml. | |
| Solution a-5 | |

-continued

| | |
|---|---|
| Gelatin | 60 g |
| KBr | 282.9 g |
| KI | 98.65 g |
| 4-Hydroxy-6-methyl-1,3,3a,7-tetrazaindene | 827 ml |
| Water to make 3 liters. | |
| Solution a-6 | |
| Gelatin | 24 g |
| KBr | 498.3 g |
| KI | 2.09 g |
| 4-Hydroxy-6-methyl-1,3,3a,7-tetrazaindene | 1.24 g |
| Water to make 1.2 liters. | |

The foregoing seed emulsion in an amount equivalent to 0.407 mole was added to Solution a-1 vigorously stirred at 50° C. with pH and pAg adjusted with acetic acid and KBr aqueous solutions.

After that, under controlled pH and pAg conditions, the above Solutions a-2 and a-3, then Solutions a-4 and a-5, further Solutions a-2 and a-3 and finally Solutions a-2 and a-6 were added by a double-jet method.

Next, the obtained solution, after adjusting pH and pAg to 6.0 and 10.1, respectively, was desalted by washing in the usual manner, and then pH was adjusted to 5.80 at 40° C., whereby a monodispersed silver iodobromide emulsion having an average grain diameter of 0.99 μm, an average silver iodide content of 8.0 mole % and a grain size distribution of 14.5% was provided. This emulsion was designated as Em-A. The silver halide grains in the emulsion Em-A are those without the surface phase of the invention.

The grain structure and the volume percentages of the respective phases of the silver halide grains in the emulsion Em-A are shown in Table I.

The pH and pAg conditions to the amounts of Ag used in the grain growing progress are as shown in Table 2.

TABLE 1

| | Phase 1 (Seed) | Phase 2 | Phase 3 | Phase 4 | Phase 5 |
|---|---|---|---|---|---|
| Silver iodide content (mol %) | 2 | 7 | 20 | 7 | 0.3 |
| Volume percentage | 3.8 | 5.2 | 24.0 | 39.0 | 28.0 |

TABLE 2

| | Grain growing conditions of Em-A | | | | |
|---|---|---|---|---|---|
| Ag (%) | 0 | 30 | 45 | 100 | |
| pH | 9.0 | → 9.0 | ↘ ↘ | ↘ 8.0 | |
| pAg | 8.2 | → 8.2 | ↘ 9.97 | → 9.97 | |

In Table 1, the Phase 1, Phase 2, Phase 3, Phase 4 and Phase 5 represent a first phase as a seed grain, a second phase toward a surface of the grain from the seed grain, a third phase toward a surface of the grain from the seed grain, a fourth phase toward a surface of the grain from the seed grain and a fifth phase toward a surface of the grain from the seed grain, respectively.

In Table 2, the Ag(%) means the percentage of the amount of Ag used on each midway step through the growing process to the amount of Ag necessary for growing the seed grains. The → means maintaining pH and pAg constant, while the ↘ means continuously lowering pH and pAg.

EXAMPLE 1

Preparation of Em-B and Em-C for the Invention

Silver halide grains were grown in the same manner as in Em-A of Comparative example 1, and to the grains, before desalting by washing, was added fine-grained silver iodide emulsion as shown in Table 3, and then the emulsions were ripened for 20 minutes to thereby cause the grain surface layer of each emulsion to have a high iodide content. After that, the emulsions were desalted by washing in the same manner as in Comparative example 1.

The emulsions thus obtained were designated as Em-B and Em-C.

TABLE 3

| Emulsion | *Added amount (%) of fine-grained silver iodide emulsion |
|---|---|
| Em-B | 25.0 |
| Em-C | 50.0 |

*: $\frac{\text{Added molar amont of fine-grained AgI emulsion}}{\text{Molar amount of Br atoms present in the whole surface of the grains contained in the emulsion}} \times 100\ (\%)$ In the grain having a pure silver bromide shell, where the first atom phase/the first and second atom phases/-the first through third atom phases thereof are highly iodized by adding the fine-grained silver iodide emulsion, the respective silver iodide content values of the grain surface phase according to the added amounts are calculated as shown in Table 4.

TABLE 4

| Added amount of fine-grained AgI emulsion (%) | AgI content (mole %) of surface phase | | |
|---|---|---|---|
| | 1st atom phase | 1st-2nd atom phases | 1st-3rd atom phases |
| 12.5 | 11.1 | 5.9 | 4.0 |
| 25.0 | 20.0 | 11.1 | 7.7 |
| 50.0 | 33.0 | 20.0 | 14.3 |
| 100 | * | 33.0 | 25.0 |
| 200 | * | * | 40.0 |

*The asterisk means that the silver iodide content exceeds the solid solution limit.

COMPARATIVE EXAMPLE 2

Preparation of Comparative Emulsion Em-D

In accordance with the method described in, Matsuzaka, Japanese Patent Application No. 23336/1990 filed by us, a comparative silver halide emulsion was prepared by using the following three-different aqueous solutions, emulsion liquid containing silver iodide fine grains and seed emulsion.

| | |
|---|---|
| Solution b-1 | |
| Gelatin | 231.9 g |
| 10% methanol solution of Compound I | 30.0 ml |
| 28% ammonia water | 1056 ml |
| Water to make 11827 ml | |
| Solution b-2 | |
| $AgNO_3$ | 1587 g |
| 28% ammonia water | 1295 ml |
| Water to make 2669 ml | |
| Solution b-3 | |
| KBr | 1572 g |
| Water to make 3774 ml | |
| Silver iodide fine grains-containing emulsion liquid b-4 | |
| Fine-grained silver iodide emulsion | 1499.3 g |

-continued

| | |
|---|---|
| 4-Hydroxy-6-methyl-1,3,3a,7-tetrazaindene | 5.2 g |
| 10% potassium hydroxide solution | 14.75 ml |
| Water to make 1373 ml. | |

The seed emulsion in an amount equivalent to 0.407 mole was added to Solution b-1 vigorously stirred at 60° C., and pH and pAg were adjusted with acetic acid and a KBr solution.

After that, with pH and pAg being controlled as shown in Table 5, Solutions b-2 and b-3 and Emulsion liquid b-4 were added by a triple-jet method at the flow rates shown in Table 6, Table 7 and Table 8.

After completion of the addition, phenylcarbamyl gelatin aqueous solution was added, and pH of the mixed solution was adjusted to thereby precipitate and aggregate the grains, and then the emulsion was desalted by washing, and after that pH was adjusted to 5.80 at 40° C., whereby a monodispersed silver iodobromide emulsion having an average grain diameter of 0.99 μm. an average silver iodide content of 8.0 mole %, and a grain size distribution of 11.2% was obtained. This emulsion was designated as Em-D.

The prescribed grain structure and the volume percentages of the respective phases of Em-D are shown in Table 9.

TABLE 5

| | Grain growing conditions of Em-D | | | | |
|---|---|---|---|---|---|
| Ag (%) | 0 | 27 | 29 | 56 | 100 |
| pH | 7.0 → | 7.0 ↓ | 6.0 → | 6.0 → | 6.0 |
| pAg | 7.8 → | 7.8 ↓ | 9.7 ↘ | 10.1 → | 10.1 |

Note:

→ means maintaining pH and pAg constant.

↘ means continuously lowering pH and pAg.

↓ means abruptly dropping pH and pAg.

TABLE 6

| b-2 addition pattern | |
|---|---|
| Time (min) | Adding rate (ml/min) |
| 0 | 12.2 |
| 25.6 | 13.0 |

TABLE 6-continued

| b-2 addition pattern | |
|---|---|
| Time (min) | Adding rate (ml/min) |
| 42.6 | 12.9 |
| 43.9 | 8.4 |
| 67.5 | 11.0 |
| 97.3 | 14.8 |
| 97.7 | 20.6 |
| 105.0 | 22.3 |
| 105.4 | 25.4 |
| 112.3 | 32.1 |
| 112.6 | 35.1 |
| 129.4 | 90.3 |
| 145.7 | 194.2 |
| 145.7 | 200.5 |
| 147.4 | 203.9 |

TABLE 7

| b-3 addition pattern | |
|---|---|
| Time (min) | Adding rate (ml/min) |
| 0 | 10.9 |
| 25.6 | 11.7 |
| 42.6 | 11.6 |
| 43.9 | 7.6 |
| 97.3 | 13.3 |
| 97.7 | 18.6 |
| 105.0 | 20.0 |
| 105.0 | 36.5 |
| 112.0 | 56.2 |
| 112.3 | 60.6 |
| 121.2 | 106.0 |
| 121.4 | 91.4 |
| 132.4 | 263.3 |
| 132.7 | 141.8 |
| 147.4 | 230.0 |

TABLE 8

| b-4 addition pattern | |
|---|---|
| Time (min) | Adding rate (ml/min) |
| 0 | 0 |
| 43.9 | 0 |
| 43.9 | 73.6 |
| 51.7 | 80.6 |
| 52.5 | 28.5 |
| 84.3 | 40.4 |
| 84.9 | 11.6 |
| 97.7 | 13.0 |
| 105.0 | 14.1 |
| 105.4 | 16.3 |
| 112.3 | 20.6 |
| 112.6 | 6.2 |
| 130.4 | 17.5 |
| 132.7 | 22.1 |
| 145.7 | 34.4 |

TABLE 9

| | Phase 1 (seed) | Phase 2 | Phase 3 | | | Phase 4 | Phase 5 | Phase 6 |
|---|---|---|---|---|---|---|---|---|
| Prescribed AgI content (mol %) | 2 | 0 | | 35 | | 10 | 3 | 0 |
| b-4/b-2 mol adding rate ratio (%) | 0 | 0 | 100* | 35 | 10 | 10 | 3 | 0 |
| Volume ratio | 3.8 | 9.2 | | 15.8 | | 6.7 | 58.7 | 5.8 |

TABLE 9-continued

| | Phase 1 (seed) | Phase 2 | Phase 3 | | | Phase 4 | Phase 5 | Phase 6 |
|---|---|---|---|---|---|---|---|---|
| (%) | | | 1.8 | 9.2 | 4.8 | | | |

Note: High iodization of silver iodobromide emulsion requires excessive silver iodide fine grains in order to obtain a desired composition.

The results obtained from the X-ray diffraction analysis show that under the conditions of Comparative example 2, by adding an excessive amount of silver iodide grains so as to make the ratio of the mole adding rate to silver ions 100% in the initial stage of forming a 35 mole % silver iodide-content phase, a highly iodized phase having as high an iodide content as 35 mole % can be obtained.

EXAMPLE 2

Preparation of Emulsions Em-E to Em-I of the Invention

Silver halide grains were grown in the same manner as in Em-D shown in Comparative example 2, and before desalting by washing, silver iodide fine grains were added thereto as shown in Table 10, and the emulsions were ripened for 20 minutes to thereby highly iodize the grain surface of each emulsion.

After that, each of the emulsions was desalted by washing in the same manner as in Comparative example 1. The emulsions thus obtained were designated as Em-E through Em-I.

TABLE 10

| Emulsion | Added amount (%) of fine-grained silver iodide emulsion |
|---|---|
| Em-E | 12.5 |
| Em-F | 25 |
| Em-G | 50 |
| Em-H | 100 |
| Em-I | 200 |

To the emulsions Em-E, F, G, H and I were added silver iodide fine grains before being desalted by washing.

COMPARATIVE EXAMPLE 3

Preparation of Comparative Emulsion Em-J

A silver iodide fine grains-containing emulsion was prepared in nearly the same manner as in Em-D of Comparative example 2 except that the silver iodide fine grains were added so as to make the silver iodide content of the phase 6 (having a prescribed thickness of about 78A) 10 mole %.

The emulsion thus obtained was designated as Em-J.

COMPARATIVE EXAMPLE 4

Preparation of Comparative Emulsion Em-K

Silver halide grains were grown in the same manner as in Em-D of Comparative example 2, and an aqueous potassium iodide solution was added thereto so that the silver iodide content of the portion about 50 Å away from the grain surface is made 10 mole % by the halogen substitution reaction at the time of completion of the addition of silver nitrate similarly to the example described in JP O.P.I. No. 106745/1988. After that the preparation was made in the same manner as in Em-D, whereby an emulsion Em-K was obtained.

COMPARATIVE EXAMPLE 5

Preparation of Comparative Emulsion Em-L

A comparative silver halide emulsion was prepared by using the following four different aqueous solutions and the seed emulsion.

| | |
|---|---|
| Solution C-1 | |
| Osein gelatin | 51.0 g |
| Distilled water | 11669 ml |
| 10% ethanol solution of Compound I | 30 ml |
| 4-Hydroxy-6-methyl-1,3,3a,7-tetrazaindene | 607.5 mg |
| 28% ammonia water | 176.0 ml |
| 56% acetic acid solution | 108 ml |
| Solution C-2 | |
| $AgNO_3$ | 1722 g |
| 28% amonia water | 1406 ml |
| Distilled water to make 1930 ml. | |
| Solution C-3 | |
| Osein gelatin | 28.11 g |
| KBr | 1182.3 g |
| KI | 33.7 g |
| 4-Hydroxy-6-methyl-1,3,3a,7-tetrazaindene | 2.03 g |
| Distilled water | 2361 ml |

The foregoing seed emulsion in an amount equivalent to 0.407 mole was added to the above Solution C-1 vigorously stirred at 40° C., and pH and pAg were adjusted with acetic acid and a KBr solution. After that, to the solution were added Solutions C-2 and C-3 under controlled pH and pAg conditions by a double jet method. The pH, pAg and adding rate of Solutions C-2 and C-3 during the mixing were controlled as shown in Table 11.

After completion of the addition, the emulsion liquid was desalted by washing, and then adjusted to pH 5.80 at 40° C., whereby a monodispersed silver iodobromide emulsion having an average grain diameter of 0.99 μm, an average silver iodide content of 2.0 mole % and a grain size distribution of 10.1 was obtained. This emulsion was designated as Em-L.

TABLE 11

| Time (min) | Adding rate (ml/min) C-2 | C-3 | pH | pAg |
|---|---|---|---|---|
| 0.00 | 8.66 | 8.24 | 9.00 | 9.0 |
| 9.43 | 15.44 | 14.69 | 8.76 | ↓ |
| 14.17 | 20.87 | 19.86 | 8.93 | ↓ |
| 18.88 | 28.44 | 27.06 | 8.88 | ↓ |
| 23.62 | 38.87 | 36.98 | 8.83 | ↓ |
| 28.33 | 52.64 | 50.72 | 8.76 | ↓ |
| 33.05 | 66.30 | 64.38 | 8.66 | ↓ |
| 37.78 | 79.91 | 78.02 | 8.54 | ↓ |
| 42.50 | 83.34 | 81.47 | 8.40 | ↓ |
| 47.23 | 84.56 | 82.68 | 8.27 | ↓ |
| 51.95 | 87.00 | 85.13 | 8.13 | ↓ |
| 56.53 | 84.02 | 82.14 | 8.00 | 9.0 |

EXAMPLE 3

Preparation of Em-M and Em-N of the Invention

Silver halide grains were grown in the same manner as in Em-L of Comparative example 5, and before desalting by washing, the fine-grained silver iodide emulsion was added as shown in Table 12, and then the emulsions were ripened for 20 minutes to thereby highly iodize the grain surface. After that, the emulsions were desalted by washing in the same manner as in Comparative example 5, and designated as Em-M and Em-N.

TABLE 12

| Emulsion | Added amount (%) of fine-grained silver iodide emulsion |
|---|---|
| Em-M | 25.0 |
| Em-N | 50.0 |

The silver iodide contents of the core portions of the above-obtained emulsions Em-A through Em-N examined by an X-ray diffraction analysis, the relative standard deviation of the silver halide contents of the respective emulsions measured according to an XMA method, and the silver iodide contents of the grain surfaces of the respective emulsions measured according to an XPS method are shown in Table 13.

Further, the emulsions Em-D through Em-I were additionally measured for their ion conductivities, whereby it was confirmed that even the emulsions Em-E and Em-F, of which the difference in the silver iodide content from Em-D is scarcely detected by the XPS measurement, has their grain surface layers highly iodized. The frequency of the peak on the higher frequency side of the dielectric loss curve of each emulsion obtained in the ion conductivity measurement is also shown in Table 13.

TABLE 13

| Emulsion | AgI content of core (mol %) | AgI content relative standard deviation (%) | AgI content of grain surface (mol %) | High freq. peak on dielectric loss curve (MHz) |
|---|---|---|---|---|
| Em-A (Comp.) | 16.5 | 18.2 | 1.8 | — |
| Em-B (Inv.) | 16.5 | 18.2 | 1.8 | — |
| Em-C (Inv.) | 16.5 | 18.2 | 2.0 | — |
| Em-D (Comp.) | 35.0 | 9.1 | 0.9 | 9.2 |
| Em-E (Inv.) | 35.0 | 9.1 | 0.9 | 12.2 |
| Em-F (Inv.) | 35.0 | 9.1 | 1.0 | 14.7 |
| Em-G (Inv.) | 35.0 | 9.1 | 1.2 | 19.4 |
| Em-H (Inv.) | 35.0 | 9.1 | 1.7 | 24.7 |
| Em-I (Inv.) | 35.0 | 9.1 | 2.4 | 26.0 |
| Em-J (Comp.) | 35.0 | 9.5 | 9.8 | — |
| Em-K (Comp.) | 35.0 | 12.3 | 10.5 | — |
| Em-L (Comp.) | 2.0 | 8.6 | 2.0 | — |
| Em-M (Inv.) | 2.0 | 8.6 | 2.1 | — |
| Em-N (Inv.) | 2.0 | 8.6 | 2.1 | — |

EXAMPLE 4

Preparation of Light-Sensitive Materials

The emulsions Em-A through Em-N prepared in Comparative examples 1 to 5 and Examples 1 to 3 were subjected to gold/sulfur sensitization and spectral sensitization. Using these emulsions, the following compositions-having layers were formed in order on a triacetyl cellulose film support, whereby multicolor photographic light-sensitive material samples were prepared.

In all the following examples, the adding amounts of the components of each silver halide photographic light-sensitive material are indicated in grams per $m^2$ unless otherwise stated except that silver halide and colloidal silver are shown in silver equivalent.

The construction of multicolor photographic light-sensitive material Sample-1 is as follows:

| Sample-1 (comparative) | |
|---|---|
| Layer 1: Anithalation layer HC-1 | |
| Black colloidal silver | 0.2 |
| UV absorbing agent UV-1 | 0.23 |
| High-boiling solvent Oil-1 | 0.18 |
| Gelatin | 1.4 |
| Layer 2: First intermediate layer IL-1 | |
| Gelatin | 1.3 |
| Layer 3: Low-speed red-sensitive emulsion layer RL | |
| Silver iodobromide emulsion Em-1 | 1.0 |
| Sensitizing dye SD-1 | $1.8 \times 10^{-5}$ mol per mol of Ag |
| Sensitizing dye SD-2 | $2.8 \times 10^{-4}$ mol per mol of Ag |
| Sensitizing dye SD-3 | $3.0 \times 10^{-4}$ mol per mol of Ag |
| Cyan coupler C-1 | 0.70 |
| Colored cyan coupler CC-1 | 0.066 |
| DIR compound D-1 | 0.03 |
| DIR compound D-3 | 0.01 |
| High-boiling solvent Oil-1 | 0.64 |
| Gelatin | 1.2 |
| Layer 4: Medium-speed red-sensitive emulsion layer RM | |
| Silver iodobromide emulsion Em-2 | 0.8 |
| Sensitizing dye SD-1 | $2.1 \times 10^{-5}$ mol per mol of Ag |
| Sensitizing dye SD-2 | $1.9 \times 10^{-4}$ mol per mol of Ag |
| Sensitizing dye SD-3 | $1.9 \times 10^{-4}$ mol per mol of Ag |
| Cyan coupler C-1 | 0.28 |
| Colored cyan coupler CC-1 | 0.027 |
| DIR compound D-1 | 0.01 |
| High-boiling solvent Oil-1 | 0.26 |
| Gelatin | 0.6 |
| Layer 5: High-speed red-sensitive emulsion RH | |
| Silver iodobromide emulsion Em-A | 1.70 |
| Sensitizing dye SD-1 | $1.9 \times 10^{-5}$ mol per mol of Ag |
| Sensitizing dye SD-2 | $1.7 \times 10^{-4}$ mol per mol of Ag |
| Sensitizing dye SD-3 | $1.7 \times 10^{-4}$ mol per mol of Ag |
| Cyan coupler C-1 | 0.05 |
| Cyan coupler C-2 | 0.10 |
| Colored cyan coupler CC-1 | 0.02 |
| DIR compound D-1 | 0.025 |
| High-boiling solvent Oil-1 | 0.17 |
| Gelatin | 1.2 |
| Layer 6: Second intermediate layer IL-2 | |
| Gelatin | 0.8 |
| Layer 7: Low-speed green-sensitive emulsion layer GL | |
| Silver iodobromide emulsion Em-1 | 1.1 |
| Sensitizing dye SD-4 | $6.8 \times 10^{-5}$ mol per mol of Ag |
| Sensitizing dye SD-5 | $6.2 \times 10^{-4}$ mol per mol of Ag |
| Magenta coupler M-1 | 0.54 |
| Magenta coupler M-2 | 0.19 |
| Colored magenta coupler CM-1 | 0.06 |
| DIR compound D-2 | 0.017 |
| DIR compound D-3 | 0.01 |
| High-boiling solvent Oil-2 | 0.81 |
| Gelatin | 1.8 |
| Layer 8: Medium-speed green-sensitive emulsion layer GM | |
| Silver iodobromide emulsion Em-2 | 0.7 |
| Sensitizing dye SD-6 | $1.9 \times 10^{-4}$ mol per mol of Ag |
| Sensitizing dye SD-7 | $1.2 \times 10^{-4}$ mol per mol of Ag |
| Sensitizing dye SD-8 | $1.5 \times 10^{-5}$ mol per mol of Ag |
| Magenta coupler M-1 | 0.07 |
| Magenta coupler M-2 | 0.03 |
| Colored magenta coupler CM-1 | 0.04 |
| DIR compound D-2 | 0.018 |
| High-boiling solvent Oil-2 | 0.30 |
| Gelatin | 0.8 |
| Layer 9: High-speed green-sensitive emulsion layer GH | |

-continued

| Sample-1 (comparative) | |
|---|---|
| Silver iodobromide emulsion Em-A | 1.7 |
| Sensitizing dye SD-4 | $2.1 \times 10^{-5}$ mol per mol of Ag |
| Sensitizing dye SD-6 | $1.2 \times 10^{-4}$ mol per mol of Ag |
| Sensitizing dye SD-7 | $1.0 \times 10^{-4}$ mol per mol of Ag |
| Sensitizing dye SD-8 | $3.4 \times 10^{-6}$ mol per mol of Ag |
| Magenta coupler M-1 | 0.09 |
| Magenta coupler M-3 | 0.04 |
| Colored magenta coupler CM-1 | 0.04 |
| High-boiling solvent Oil-2 | 0.31 |
| Gelatin | 1.2 |
| Layer 10: Yellow filter layer YC | |
| Yellow colloidal silver | 0.05 |
| Antistain agent SC-1 | 0.1 |
| High-boiling solvent Oil-2 | 0.13 |
| Gelatin | 0.7 |
| Formalin scavenger HS-1 | 0.09 |
| Formalin scavenger HS-2 | 0.07 |
| Layer 11: Low-speed blue-sensitive emulsion BL | |
| Silver iodobromide emulsion Em-1 | 0.5 |
| Silver iodobromide emulsion Em-2 | 0.5 |
| Sensitizing dye SD-9 | $5.2 \times 10^{-4}$ mol per mol of Ag |
| Sensitizing dye SD-10 | $1.9 \times 10^{-5}$ mol per mol of Ag |
| Yellow coupler Y-1 | 0.65 |
| Yellow coupler Y-2 | 0.24 |
| DIR compound D-1 | 0.03 |
| High-boiling solvent Oil-2 | 0.18 |
| Gelatin | 1.3 |
| Formalin scavenger HS-1 | 0.08 |
| Layer 12: High-speed blue-sensitive emulsion layer BH | |
| Silver iodobromide emulsion Em-A | 1.0 |
| Sensitizing dye SD-9 | $1.8 \times 10^{-4}$ mol per mol of Ag |
| Sensitizing dye SD-10 | $7.9 \times 10^{-5}$ mol per mol of Ag |
| Yellow coupler Y-1 | 0.15 |
| Yellow coupler Y-2 | 0.05 |

-continued

| Sample-1 (comparative) | |
|---|---|
| High-boiling solvent Oil-2 | 0.074 |
| Gelatin | 1.30 |
| Formalin scavenger HS-1 | 0.05 |
| Formalin scavenger HS-2 | 0.12 |
| Layer 13: First protective layer Pro-1 | |
| Fine-grained silver iodobromide emulsion (containing 1 mol % AgI having an average grain size of 0.08 μm) | 0.4 |
| UV absorbing agent UV-1 | 0.07 |
| UV absorbing agent UV-2 | 0.10 |
| High-boiling solvent Oil-1 | 0.07 |
| High-boiling solvent Oil-3 | 0.07 |
| Formalin scavenger HS-1 | 0.13 |
| Formalin scavenger HS-2 | 0.37 |
| Gelatin | 1.3 |
| Layer 14: Second protective layer Pro-2 | |
| Alkali-soluble matting agent (average particle size: 2 μm) | 0.13 |
| Poly(methyl methacrylate) (average particle size: 3 μm) | 0.02 |
| Sliding agent WAX-1 | 0.04 |
| Gelatin | 0.6 |

Besides the above components, coating aid Su-1, dispersion aid Su-2, viscosity control agent, hardeners H-1 and H-2, stabilizer ST-1, antifoggant AF-1, and two kinds of AF-2, one having a Mw of 10,000 and the other a Mw of 1,100,000, were added.

The emulsions Em-1 and Em-2 used in the above sample are as shown in Table 14. Each emulsion was subjected to an optimum sensitization treatment.

TABLE 14

| Emulsion | Average rain size (μm) | Average AgI content | Crystal habit |
|---|---|---|---|
| Em-1 | 0.47 | 8.0 | Octahedron to tetradecahedron |
| Em-2 | 0.82 | 8.0 | Octahedron |

C-1

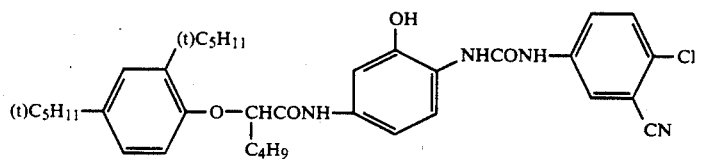

C-2

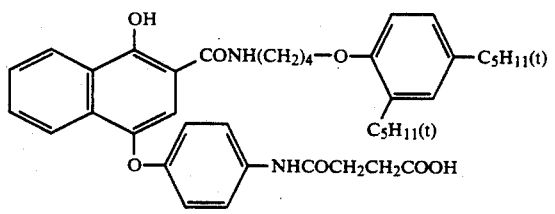

M-1

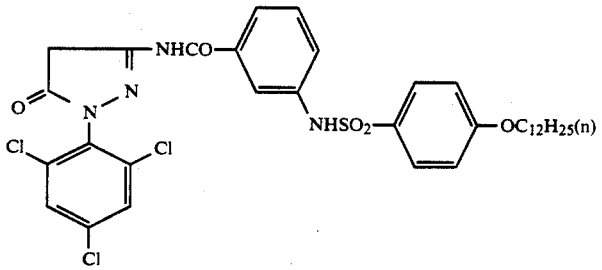

-continued
M-2
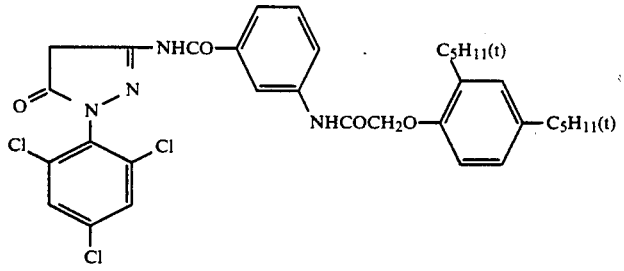
M-3
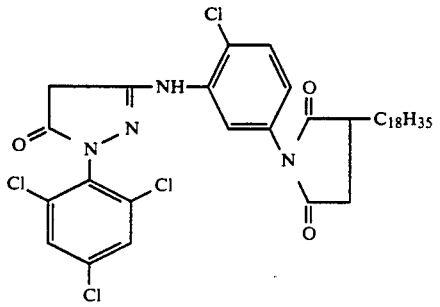
Y-1
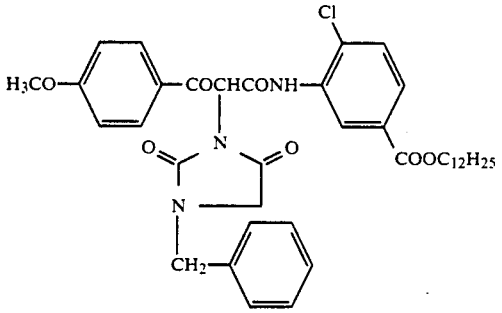
Y-2
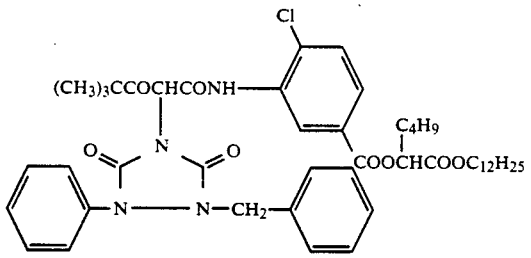
CC-1
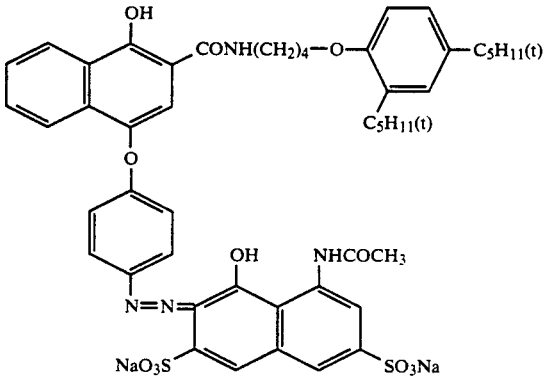

-continued
CM-1
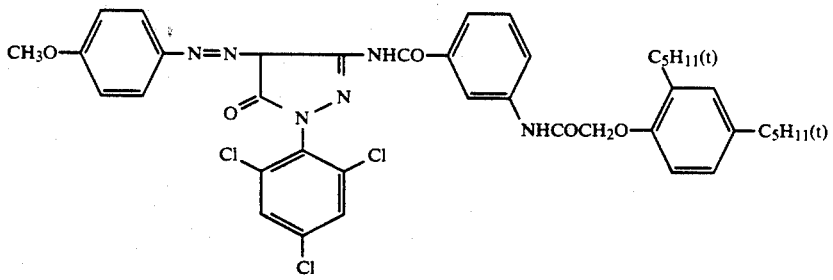
D-1
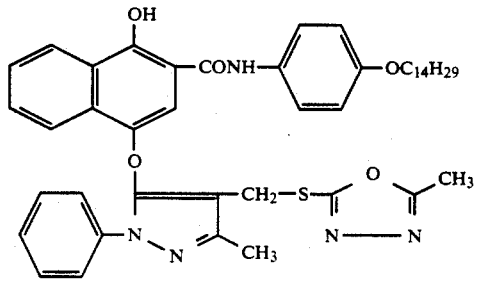
D-2
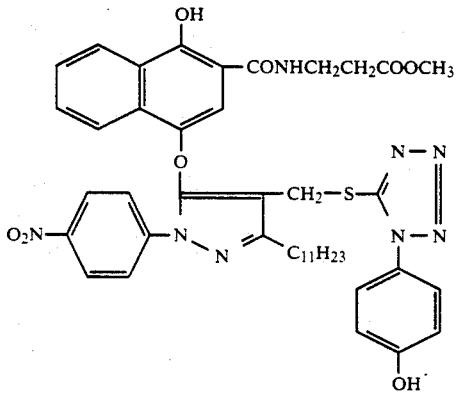
D-3
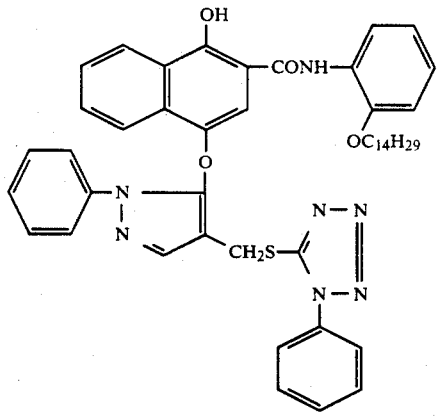
Oil-1
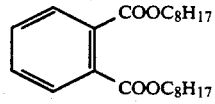
Oil-2
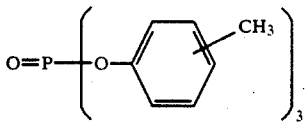

-continued
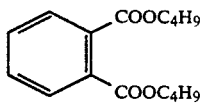
Oil-3
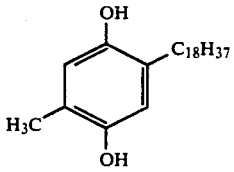
(sec) SC-1
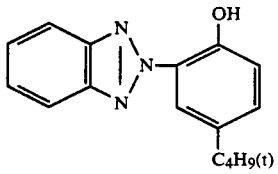
UV-1
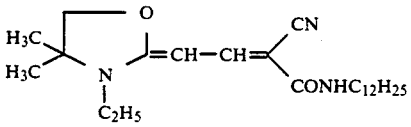
UV-2
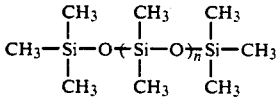
Weight average molecular weight $\overline{Mw}$ = 3,000
WAX-1
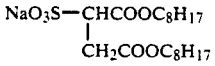
Su-1
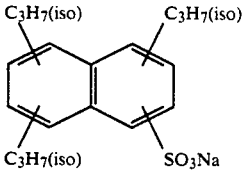
Su-2
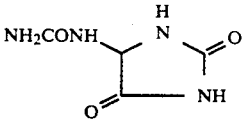
HS-1
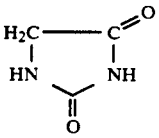
HS-2
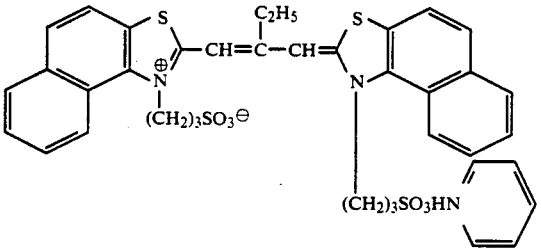
(SD-1)

-continued
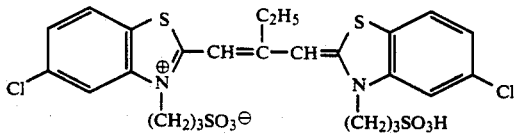
(SD-2)
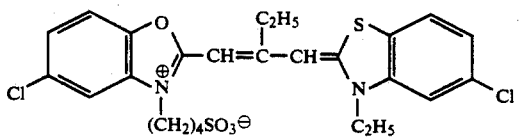
(SD-3)
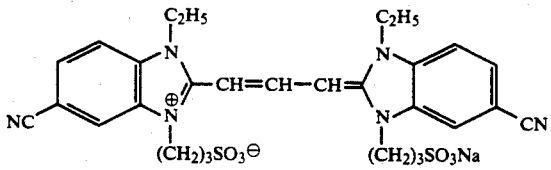
(SD-4)
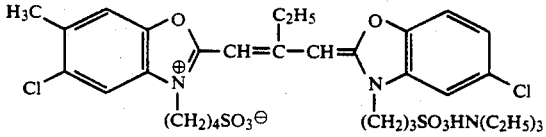
(SD-5)
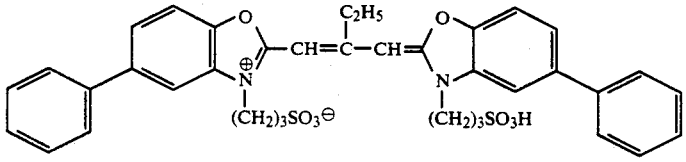
(SD-6)
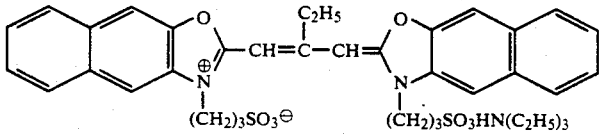
(SD-7)
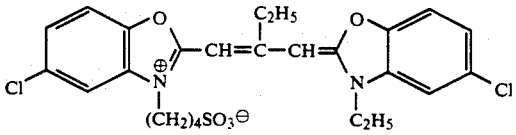
(SD-8)
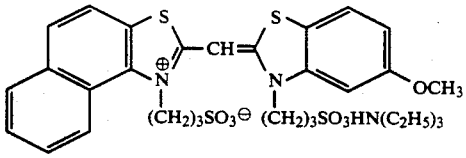
(SD-6)
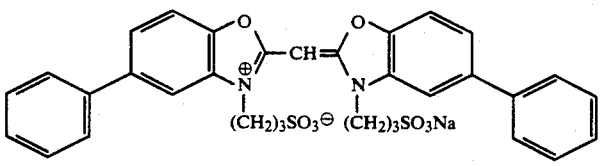
(SD-10)
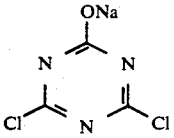
H-1
$(CH_2{=}CHSO_2CH_2)_2O$
H-2

-continued

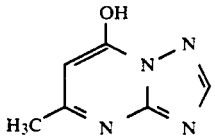

ST-1

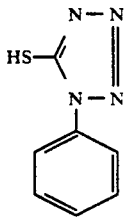

AF-1

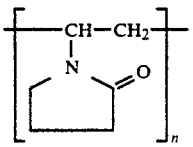

AF-2 n: Polymerization degree

Subsequently, Samples 2 through 14 were prepared in the same manner as in the above Sample 1 except that the silver iodobromide Emulsion-A in Layers-5, 9 and 12 was replaced by the emulsions Em-B through Em-N as shown in Tables-15, 16 and 17.

Each of the samples thus prepared was exposed through an optical wedge to a white light, and then processed in the following steps:

| | |
|---|---|
| 1. Color developing | 3 min. 15 sec. at 38.0 ± 0.1° C. |
| 2. Bleaching | 6 min. 30 sec. at 38.0 ± 3.0° C. |
| 3. Washing | 3 min. 15 sec. at 24 to 41° C. |
| 4. Fixing | 6 min. 30 sec. at 38.0 ± 3.0° C. |
| 5. Washing | 3 min. 15 sec. at 24 to 41° C. |
| 6. Stabilizing | 3 min. 15 sec. at 38.0 ± 3.0° C. |
| 7. Drying | at lower than 50° C. |

The compositions of the respective processing solutions used in the above steps are as follows:

| | |
|---|---|
| Color developer | |
| 4-Amino-3-methyl-N-ethyl-N-(β-hydroxyethyl)-aniline sulfate | 4.75 g |
| Anhydrous sodium sulfite | 4.25 g |
| Hydroxyamine ½ sulfate | 2.0 g |
| Anhydrous potassium carbonate | 37.5 g |
| Sodium bromide | 1.3 g |
| Trisodium nitrilotriacetate, monohydrated | 2.5 g |
| Potassium hydroxide | 1.0 g |
| Water make 1 liter (pH = 10.1) | |
| Bleaching bath | |
| Ferric-ammonium ethylenediaminetetraacetate | 100.0 g |
| Ammonium ethylenediaminetetraacetate | 10.0 g |
| Ammonium bromide | 150.0 g |
| Glacial acetic acid | 10.0 g |
| Water to make 1 liter, adjust pH to 6.0 with ammonia water. | |
| Fixing bath | |
| Ammonium thiosulfate | 175.0 g |
| Anhydrous sodium sulfite | 8.5 g |
| Sodium metabisulfite | 2.3 g |
| Water to make 1 liter, adjust pH to 6.0 with acetic acid. | |
| Stabilizing bath | |
| Formalin (37% solution) | 1.5 ml |
| Koniducks, product of KONICA Corp. | 7.5 ml |

-continued

| |
|---|
| Water to make 1 liter. |

The relative fog values, relative sensitivities and relative RMS values of the processed samples, immediately after the processing, were measured with use of red light (R), green light (G) and blue light (B). The results are shown in Tables 15 to 17.

The relative fog values of each sample are the relative minimum density (Dmin) values obtained in the R, G and B measurements and are indicated in values relative to the Dmin values of R, G and B densities of Sample-1 set at 100, respectively.

The relative sensitivity values are the relative values of reciprocal of the exposure amounts giving Dmin+0.15 densities in the R, G and B measurements and are indicated relative to the R, G and B sensitivities of Sample-1 each set at 100.

The relative RMS values-measured area on each sample is the area giving Dim+0.15 densities in the R, G and B measurements as in the case of the relative sensitivities.

The relative RMS values for R, G and B are measured in the manner that each sample is scanned by a microdensitometer having a head slit area of 1800 $\mu m^2$ (10 μm wide and 180 μm long) loaded with an Eastman Kodak Wratten Filter W-26, W-99 or W-47 for the measurement of R, G or B, respectively, to make more than 1000 density measurement samplings thereon to find a standard deviation of the density values fluctuation with respect to each of the R, G and B, and the obtained RMS values are indicated in values relative to those of Sample-1 each set at 100. The smaller the RMS values, the better the graininess.

Also, each sample was allowed to stand for five full days under high temperature/humidity conditions of 50° C./80%RH, then exposed through an optical wedge to a while light, and then processed. After that, each processed sample was subjected to measurements for the R, G and B sensitivities, of which the relative values to the sensitivities of the non-aged Sample-1 each set at 100, are shown together in the tables.

TABLE 15

| Sample No. | Emulsion used in Layers 5, 9 and 12 | Red-sensitive layer: Relative sensitivity: Non-aged | Red-sensitive layer: Relative sensitivity: 50° C./80% RH for 5 days | Red-sensitive layer: Relative fog | Red-sensitive layer: Relative RMS value |
|---|---|---|---|---|---|
| 1 | EM-A (Comp.) | 100 | 85 | 100 | 100 |
| 2 | Em-B (Inv.) | 105 | 95 | 100 | 100 |
| 3 | Em-C (Inv.) | 110 | 105 | 100 | 95 |
| 4 | Em-D (Comp.) | 120 | 85 | 80 | 75 |
| 5 | Em-E (Inv.) | 130 | 120 | 80 | 75 |
| 6 | Em-F (Inv.) | 140 | 130 | 80 | 70 |
| 7 | Em-G (Inv.) | 145 | 140 | 75 | 70 |
| 8 | Em-H (Inv.) | 135 | 135 | 80 | 70 |
| 9 | Em-I (Inv.) | 130 | 135 | 75 | 70 |
| 10 | Em-J (Comp.) | 70 | 65 | 85 | 90 |
| 11 | Em-K (Comp.) | 65 | 65 | 80 | 95 |
| 12 | Em-L (Comp.) | 80 | 70 | 110 | 115 |
| 13 | Em-M (Inv.) | 80 | 70 | 110 | 115 |
| 14 | Em-N (Inv.) | 85 | 80 | 110 | 115 |

TABLE 16

| Sample No. | Emulsion used in Layers 5, 9 and 12 | Green-sensitive layer: Relative sensitivity: Non-aged | Green-sensitive layer: Relative sensitivity: 50° C./80% RH for 5 days | Green-sensitive layer: Relative fog | Green-sensitive layer: Relative RMS value |
|---|---|---|---|---|---|
| 1 | EM-A (Comp.) | 100 | 80 | 100 | 100 |
| 2 | Em-B (Inv.) | 100 | 90 | 100 | 100 |
| 3 | Em-C (Inv.) | 110 | 105 | 95 | 100 |
| 4 | Em-D (Comp.) | 120 | 85 | 85 | 75 |
| 5 | Em-E (Inv.) | 130 | 110 | 80 | 75 |
| 6 | Em-F (Inv.) | 140 | 130 | 85 | 75 |
| 7 | Em-G (Inv.) | 140 | 135 | 80 | 70 |
| 8 | Em-H (Inv.) | 135 | 135 | 80 | 70 |
| 9 | Em-I (Inv.) | 125 | 125 | 75 | 75 |
| 10 | Em-J (Comp.) | 75 | 70 | 90 | 85 |
| 11 | Em-K (Comp.) | 70 | 65 | 85 | 85 |
| 12 | Em-L (Comp.) | 80 | 65 | 115 | 120 |
| 13 | Em-M (Inv.) | 85 | 75 | 115 | 120 |
| 14 | Em-N (Inv.) | 85 | 80 | 115 | 115 |

TABLE 17

| Sample No. | Emulsion used in Layers 5, 9 and 12 | Blue-sensitive layer: Relative sensitivity: Non-aged | Blue-sensitive layer: Relative sensitivity: 50° C./80% RH for 5 days | Blue-sensitive layer: Relative fog | Blue-sensitive layer: Relative RMS value |
|---|---|---|---|---|---|
| 1 | EM-A (Comp.) | 100 | 85 | 100 | 100 |
| 2 | Em-B (Inv.) | 100 | 95 | 100 | 100 |
| 3 | Em-C (Inv.) | 105 | 105 | 100 | 100 |
| 4 | Em-D (Comp.) | 125 | 90 | 80 | 80 |
| 5 | Em-E (Inv.) | 130 | 115 | 75 | 80 |
| 6 | Em-F (Inv.) | 135 | 125 | 80 | 80 |
| 7 | Em-G (Inv.) | 140 | 140 | 75 | 75 |
| 8 | Em-H (Inv.) | 130 | 125 | 75 | 75 |
| 9 | Em-I (Inv.) | 130 | 130 | 75 | 75 |
| 10 | Em-J (Comp.) | 80 | 80 | 90 | 90 |
| 11 | Em-K (Comp.) | 70 | 65 | 80 | 90 |
| 12 | Em-L (Comp.) | 70 | 60 | 110 | 120 |
| 13 | Em-M (Inv.) | 75 | 70 | 110 | 115 |
| 14 | Em-N (Inv.) | 75 | 70 | 110 | 120 |

As is apparent from Tables 15 to 17, the light-sensitive material Samples 2, 3, 5 to 9, 13 and 14, comprising silver halide grains of which each surface phase has a higher silver iodide content than the internal phase thereof, have higher sensitivities, more excellent preservabilities and equal or better graininess than the corresponding comparative examples.

The effect of the invention is remarkable in the internally highly iodized core/shell-type emulsion, and more remarkable in the core/shell-type emulsion in which the internal grain structure is highly controlled.

EXAMPLE 5

The silver iodobromide emulsions I to IV shown in Table 18 were prepared in accordance with the method described in JP O.P.I. NO. 138538/1985.

TABLE 18

| Emulsion | Average grain diameter (μm) | Average halogen composition (mol %) Br | I | Surface halogen* composition (mol %) Br | I | Other characteristics |
|---|---|---|---|---|---|---|
| I | 0.7 | 92.0 | 8.0 | 98.8 | 1.2 | Core/shell-type octahedral grain containing 30/0.5 mol % iodine. |
| II | 0.6 | 97.5 | 2.5 | 99.2 | 0.8 | Core/shell-type octahedral grain containing 30/0 mol % iodine. |
| III | 0.7 | 92.0 | 8.0 | 93.0 | 7.0 | Prepared by adding a KI solution after completion of adding $AgNO_3$ in Em I. |
| IV | 0.9 | 92.0 | 8.0 | 99.1 | 0.9 | Core/shell-type-octahedral grain containing 30/0.5 mol % iodine. |

The halogen composition was measured in accordance with the foregoing X-ray photoelectron spectral analysis method.

Next, a fine-grained silver iodide emulsion A was prepared by adding one mole of silver nitrate, using a 3.5N silver nitrate solution, and one mole of potassium iodide, using a 3.5N potassium iodide solution, at a constant speed in 30 minutes to an aqueous 5 wt % Osein gelatin solution with stirring at 40° C. in a reactor. During the above addition, pAg was maintained at 13.5 by a usual pAg control means.

The produced silver iodide was a mixture of β-AgI and γ-AgI having an average grain diameter of 0.06 μm.

Subsequently, the fine-grained silver halide emulsions B and C shown in the following Table I9 were prepared in the same manner except that the potassium iodide solution was replaced by a potassium iodide/potassium bromide mixed solution or a potassium bromide solution.

For comparison, an octahedral fine-grained monodispersed silver bromide emulsion D containing 30 mole % silver iodide was prepared in the presence of ammonia by a controlled double-jet method.

TABLE 19

| Fine-grained silver halide emulsions: Fine-grained silver halide | Halogen composition (mol %) Br | I | Average grain diameter |
|---|---|---|---|
| A | 0 | 100 | 0.06 μm |
| B | 70 | 30 | 0.07 μm |
| C | 100 | 0 | 0.07 μm |
| D (Comp.) | 70 | 30 | 0.22 μm |

The silver iodobromide emulsions I to IV were so chemically ripened as to have optimum sensitivities, using appropriate amounts of sodium thiosulfate, chloroauric acid and ammonium thiocyanate, at the temperatures given in Table 20.

For stopping the chemical ripening, 4-hydroxy-6-methyl-1,3,3a,7-tetrazaindene was used, and the ripening temperature was dropped simultaneously with the addition of the agent.

In the above chemical ripening process, the fine-grained silver halide emulsions given in Table 19 Were added, whereby the chemically ripened emulsions of the invention and comparative emulsions were prepared.

The prepared emulsions and the preparation conditions are shown in Table 20.

TABLE 20

| Ripened Em name | Em name before ripening | Ripening temp. | Ripening* time (min) | Added fine-grained silver halide or comparative compound: Kind | Amount** | Added stage | Remarks |
|---|---|---|---|---|---|---|---|
| I-1 | I | 55° C. | 100 | None | — | — | Comp. |
| I-2 | I | 55° C. | 100 | Fine-grained AgX A | $1.0 \times 10^{-3}$ | After*** | Inv. |
| I-3 | I | 55° C. | 100 | KI | $1.0 \times 10^{-3}$ | After | Comp. |
| III-1 | III | 55° C. | 110 | None | — | — | Comp. |
| III-2 | III | 55° C. | 110 | Fine-grained AgX A | $1.0 \times 10^{-3}$ | After | Comp. |
| IV-1 | IV | 52° C. | 90 | None | — | — | Comp. |
| IV-2 | IV | 52° C. | 90 | Fine-grained AgX A | $2.0 \times 10^{-4}$ | After | Inv. |
| IV-3**** | VI | 52° C. | 90 | Fine-grained AgX A | $7.0 \times 10^{-4}$ | After | Inv. |
| IV-4 | IV | 52° C. | 90 | Fine-grained AgX A | $2.0 \times 10^{-3}$ | After | Inv. |
| IV-5 | IV | 52° C. | 90 | Fine-grained AgX A | $1.5 \times 10^{-2}$ | After | Inv. |
| IV-6 | IV | 52° C. | 90 | KI | $2.0 \times 10^{-4}$ | After | Comp. |
| IV-7 | IV | 52° C. | 90 | KI | $7.0 \times 10^{-4}$ | After | Comp. |

Note:
*The time interval from the addition of sodium thiosulfate until the addition of the chemical ripening stopping agent (4-hydroxy-6-methyl-1,3,3a,7-tetrazaindene).
**Molar amount per mole of silver of emulsion before being chemically ripened.
***Added 75 minutes after the addition of sodium thiosulfate.
****The iodide content was found 1.0 mole % when the surface halogen composition of Emulsion IV-3 was measured according to the foregoing x-ray photoelectron spectral analysis.

Of the emulsions shown in Table 20, to Emulsion IV-I was added sensitizing dyes SD-4, SD-6, SD-7 and SD-8 as shown below 10 minutes before adding sodium thiosulfate, and the emulsion was coated on a triacetyl cellulose film support, whereby a monolayer color light-sensitive Sample-1 having the following composition was prepared.

| Sample-1 | |
|---|---|
| Silver iodobromide emulsion IV-1 in Table 20 | 2.0 |
| Sensitizing dye SD-4 | $2.1 \times 10^{-5}$ |
| Sensitizing dye SD-6 | $1.2 \times 10^{-4}$ |
| Sensitizing dye SD-7 | $1.0 \times 10^{-4}$ |
| Sensitizing dye SD-8 | $3.4 \times 10^{-6}$ |
| Magenta coupler M-1 | 0.11 |
| Magenta coupler M-3 | 0.05 |
| High-boiling solvent Oil-2 | 0.36 |
| Gelatin | 3.0 |

In addition to the above additives, coating aids Su-1 and Su-2 and hardener H-1 were added.

Further, Sample-2, Sample-3 and Sample-4 were prepared in the same manner except that the silver iodobromide IV-I was replaced by IV-2, IV-3 and IV-7.

The above-prepared Samples-1 to 4 were each allowed to stand under 40° C./80%RH conditions for one week. The samples thus aged and the same non-aged were each subjected to reflection spectrum measurement with a Hitachi Automatic Spectrophotometer photometer U-3210, equipped with an integral sphere. As a result, each sample showed its maximum absorption in about 360 nm. The absorbance of each sample compared with that of the subbed base support in this instance was measured. The results are shown in the following table.

| Sample No. | Emulsion of Table 20 used | Reflection spectrum of coated sample (Abs) Non-aged | 1 week aged under 40° C./80% RH |
|---|---|---|---|
| 1 (Comp.) | IV-1 | 0.85 | 0.68 |
| 2 (Inv.) | IV-2 | 0.88 | 0.82 |
| 3 (Inv.) | IV-3 | 0.88 | 0.96 |
| 4 (Comp.) | IV-7 | 0.86 | 0.77 |

As is apparent from the above table, the samples prepared by adding the fine-grained silver halide of the invention, after being aged under 40° C./80%RH conditions for 7 days, show remarkably reduced adsorbance drops and improved adsorptions of the sensitizind dyes as compared to Sample-1 containing no fine-grained silver halide. Even when compared with Sample-4 to which KI was added, the samples showed less absorbance drops.

Next, Samples 101 to 111 were prepared in the same manner as in the following multicolor photographic light-sensitive material except that the silver iodobromide emulsion in Layers 4, 5, 8, 9 and 12 was replaced as shown in Table 21.

TABLE 21

| Sample | Emulsion of Layer 4 | Emulsion of Layer 5 | Emulsion of Layer 8 | Emulsion of Layer 9 | Emulsion of Layer 12 |
|---|---|---|---|---|---|
| 101 (Comp.) | I-1 | IV-1 | I-1 | IV-1 | IV-1 |
| 102 (Comp.) | I-3 | IV-6 | I-3 | IV-6 | IV-6 |
| 103 (Comp.) | I-3 | IV-7 | I-3 | IV-7 | IV-7 |
| 104 (Comp.) | III-1 | IV-1 | III-1 | IV-1 | IV-1 |
| 105 (Comp.) | III-2 | IV-1 | III-2 | IV-1 | IV-1 |
| 106 (Inv.) | I-1 | IV-5 | I-1 | IV-5 | IV-5 |
| 107 (Inv.) | III-2 | IV-3 | III-2 | IV-3 | IV-3 |
| 108 (Inv.) | I-2 | IV-1 | I-2 | IV-1 | IV-1 |
| 109 (Inv.) | I-2 | IV-2 | I-2 | IV-2 | IV-2 |
| 110 (Inv.) | I-2 | IV-3 | I-2 | IV-3 | IV-3 |
| 111 (Inv.) | I-2 | IV-4 | I-2 | IV-4 | IV-4 |

On a triacetyl cellulose film support were coated in order from the support side the following compositions-having layers, whereby a multicolor photographic light-sensitive material was prepared.

| | |
|---|---|
| Layer 1: Antihalation layer HC-1 | |
| Black colloidal silver | 0.2 |
| UV abosrbing agent UV-1 | 0.23 |
| High-boiling solvent Oil-1 | 0.18 |
| Gelatin | 1.4 |
| Layer 2: First intermediate layer IL-1 | |
| Gelatin | 1.3 |
| Layer 3: Low-speed red-sensitive emulsion layer RL | |
| Silver iodobromide emulsion (average grain diameter: 0.4 μm) | 1.0 |
| Sensitizing dye SD-1 | $1.8 \times 10^{-5}$ |
| Sensitizing dye SD-2 | $2.8 \times 10^{-4}$ |
| Sensitizing dye SD-3 | $3.0 \times 10^{-4}$ |
| Cyan coupler C-1 | 0.70 |
| Colored cyan coupler CC-1 | 0.066 |
| DIR compound D-1 | 0.03 |
| DIR compound D-3 | 0.01 |
| High-boiling solvent Oil-1 | 0.64 |
| Gelatin | 1.2 |
| Layer 4: Medium-speed red-sensitive emulsion layer RM | |
| Silver iodobromide emulsion | 0.8 |
| Sensitizing dye SD-1 | $2.1 \times 10^{-5}$ |
| Sensitizing dye SD-2 | $1.9 \times 10^{-4}$ |
| Sensitizing dye SD-3 | $1.9 \times 10^{-4}$ |
| Cyan coupler C-1 | 0.28 |
| Colored cyan coupler CC-1 | 0.027 |
| DIR compound D-1 | 0.01 |
| High-boiling solvent Oil-1 | 0.26 |
| Gelatin | 0.6 |
| Layer 5: High-speed red-sensitive emulsion layer RH | |
| Silver iodobromide emulsion | 1.70 |
| Sensitizing dye SD-1 | $1.9 \times 10^{-5}$ |
| Sensitizing dye SD-2 | $1.7 \times 10^{-4}$ |
| Sensitizing dye SD-3 | $1.7 \times 10^{-4}$ |
| Cyan coupler C-1 | 0.05 |
| Cyan coupler C-1 | 0.10 |
| Colored cyan coupler CC-1 | 0.02 |
| DIR compound D-1 | 0.025 |
| High-boiling solvent Oil-1 | 0.17 |
| Gelatin | 1.2 |
| Layer 6: Second intermediate layer IL-2 | |
| Gelatin | 0.8 |
| Layer 7: Low-speed green sensitive emulsion layer GL | |
| Silver iodobromide emulsion (average grain diameter: 0.4 μm) | 1.1 |
| Sensitizing dye SD-4 | $6.8 \times 10^{-5}$ |
| Sensitizing dye SD-5 | $6.2 \times 10^{-4}$ |
| Magenta coupler M-1 | 0.54 |
| Magenta coupler M-2 | 0.19 |
| Colored magenta coupler CM-1 | 0.06 |
| DIR compound D-2 | 0.017 |
| DIR compound D-3 | 0.01 |
| High-boiling solvent Oil-2 | 0.81 |
| Gelatin | 1.8 |
| Layer 8: Medium-speed green-sensitive emulsion layer GM | |
| Silver iodobromide emulsion | 0.7 |
| Sensitizing dye SD-6 | $1.9 \times 10^{-4}$ |
| Sensitizing dye SD-7 | $1.2 \times 10^{-4}$ |
| Sensitizing dye SD-8 | $1.5 \times 10^{-5}$ |
| Magenta coupler M-1 | 0.07 |
| Magenta coupler M-2 | 0.03 |
| Colored magenta coupler CM-1 | 0.04 |
| DIR compound D-2 | 0.018 |
| High-boiling solvent Oil-2 | 0.30 |
| Gelatin | 0.8 |
| Layer 9: High-speed green-sensitive emulsion layer GH | |
| Silver iodobromide emulsion | 1.7 |
| Sensitizing dye SD-4 | $2.1 \times 10^{-5}$ |
| Sensitizing dye SD-6 | $1.2 \times 10^{-4}$ |
| Sensitizing dye SD-7 | $1.0 \times 10^{-4}$ |
| Sensitizing dye SD-8 | $3.4 \times 10^{-6}$ |
| Magenta coupler M-1 | 0.09 |
| Magenta coupler M-3 | 0.04 |
| Colored magenta coupler CM-1 | 0.04 |
| High-boiling solvent Oil-2 | 0.31 |
| Gelatin | 1.2 |

-continued

| | |
|---|---|
| Layer 10: Yellow filter layer YC | |
| Yellow colloid layer | 0.05 |
| Antistain agent SC-1 | 0.1 |
| High-boiling solvent Oil-2 | 0.13 |
| Gelatin | 0.7 |
| Formalin scavenger HS-1 | 0.09 |
| Formalin scavenger HS-2 | 0.07 |
| Layer 11: Low-speed blue-sensitive emulsion layer BL | |
| Silver iodobromide emulsion (average grain diameter: 0.4 μm) | 0.3 |
| Silver iodobromide emulsion (average grain diameter: 0.7 μm) | 0.5 |
| Sensitizing dye SD-9 | $5.2 \times 10^{-4}$ |
| Sensitizing dye SD-10 | $1.9 \times 10^{-5}$ |
| Yellow coupler Y-1 | 0.65 |
| Yellow coupler Y-2 | 0.24 |
| DIR compound D-1 | 0.03 |
| High-boiling solvent Oil-2 | 0.18 |
| Gelatin | 1.3 |
| Formalin scavenger HS-1 | 0.08 |
| Layer 12: High-speed blue-sensitive emulsion layer BH | |
| Silver bromide emulsion | 1.0 |
| Sensitizing dye SD-9 | $1.8 \times 10^{-4}$ |
| Sensitizing dye SD-10 | $7.9 \times 10^{-5}$ |
| Yellow coupler Y-1 | 0.15 |
| Yellow coupler Y-2 | 0.05 |
| High-boiling solvent Oil-2 | 0.074 |
| Gelatin | 1.30 |
| Formalin scavenger HS-1 | 0.05 |
| Formalin scavenger HS-2 | 0.12 |
| Layer 13: First protective layer Pro-1 | |
| Fine-grained silver iodobromide emulsion (1 mole % AgI, average grain diameter: 0.08 μm) | 0.4 |
| UV absorbing agent UV-1 | 0.07 |
| UV absorbing agent UV-2 | 0.10 |
| High-boiling solvent Oil-1 | 0.07 |
| High-boiling solvent Oil-3 | 0.07 |
| Formalin scavenger HS-1 | 0.13 |
| Formalin scavenger HS-2 | 0.37 |
| Gelatin | 1.3 |
| Layer 14: Second protective layer Pro-2 | |
| Alkali-soluble matting agent (average particle size: 2 μm) | 0.13 |
| Poly(methyl methacrylate) (average particle size: 3 μm) | 0.02 |
| Sliding agent WAX-1 | 0.04 |
| Gelatin | 0.6 |

Besides the above components, there were added coating aid Su-1, dispersing aid Su-2, viscosity adjusting agent, hardeners H-1 and H-2, stabilizing agent ST-1, antifoggant AF-1 and two kinds of AF-1, one having a $\overline{Mw}$ of 10,000 and the other having a $\overline{MW}$ of 1,100,000.

The above-prepared samples 101 through 111 were allowed to stand under 40° C./80%RH conditions for one week. The thus aged samples and the non-aged samples were each exposed through an optical wedge to a white light, and then processed as follows:

Processing A

| | |
|---|---|
| 1. Color developing | 3 min. 15 sec. at 38.0 ± 0.1° C. |
| 2. Bleaching | 6 min. 30 sec. at 30.0 ± 3.0° C. |
| 3. Washing | 3 min. 15 sec. at 24 to 41° C. |
| 4. Fixing | 6 min. 30 sec. at 38.0 ± 3.0° C. |
| 5. Washing | 3 min. 15 sec. at 24 to 41° C. |
| 6. Stabilizing | 1 min. 15 sec. at 38.0 ± 3.0° C. |
| 7. Drying | at lower than 50° C. |

The compositions of the processing solutions used in the above steps are as follows:

| | |
|---|---|
| Color developer | |
| 4-Amino-3-methyl-N-ethyl-N-(β-hydroxyethyl)-aniline sulfate | 4.75 g |
| Anhydrous sodium sulfite | 4.25 g |
| Hydroxylamine ½ sulfate | 2.0 g |
| Anhydrous potassium carbonate | 37.5 g |
| Sodium bromide | 1.3 g |
| Trisodium nitrilotriacetate, monohydrated | 2.5 g |
| Potassium hydroxide | 1.0 g |
| Water to make 1 liter (pH = 10.0) | |
| Bleaching bath | |
| Ferric-ammonium ethylenediaminetetraacetate | 100 g |
| Ammonium ethylenediaminetetraacetate | 10 g |
| Ammonium bromide | 150 g |
| Glacial acetic acid | 10 ml |
| Water to make 1 liter, adjust pH to 6.0 with ammonia water. | |
| Fixing bath | |
| Ammonium thiosulfate | 175 g |
| Anhydrous sodium sulfite | 8.5 g |
| Sodium metabisulfite | 2.3 g |
| Water to make 1 liter, adjust pH to 6.0 with acetic acid. | |
| Stabilizing bath | |
| Formalin (37% solution) | 1.5 ml |
| Koniducks (product of KONICA Corp.) | 7.5 ml |
| Water to make 1 liter. | |

Each processed sample was subjected to measurement for the densities thereof by red(R), green(G) and blue(B) lights to thereby find the sensitivities of the red-sensitive layer, green-sensitive layer and blue-sensitive layer thereof.

Each of the sensitivities is a reciprocal of the exposure amount necessary to give a density of Dmin+0.4 and indicated in a value relative to the R, G or B sensitivity of Sample 101 set at 100. The results are shown in Table 22.

TABLE 22

| | Right after preparation Sensitivities | | | Aged 7 days under 40° C./80% RH Sensitivities | | |
|---|---|---|---|---|---|---|
| Sample | Red-sensitive layer | Green-sensitive layer | Blue-sensitive layer | Red-sensitive layer | Green-sensitive layer | Blue-sensitive layer |
| 101 (Comp.) | 100 | 100 | 100 | 75 | 70 | 85 |
| 102 (Comp.) | 80 | 75 | 80 | 70 | 60 | 70 |
| 103 (Comp.) | 60 | 50 | 60 | 60 | 45 | 60 |
| 104 (Comp.) | 95 | 95 | 90 | 90 | 80 | 85 |
| 105 (Comp.) | 90 | 85 | 80 | 80 | 85 | 75 |
| 106 (Inv.) | 90 | 95 | 95 | 90 | 90 | 95 |
| 107 (Inv.) | 105 | 110 | 110 | 105 | 105 | 105 |
| 108 (Inv.) | 110 | 115 | 115 | 100 | 105 | 110 |
| 109 (Inv.) | 110 | 120 | 115 | 105 | 110 | 110 |
| 110 (Inv.) | 125 | 135 | 120 | 125 | 135 | 120 |
| 111 (Inv.) | 115 | 125 | 110 | 115 | 120 | 110 |

As is apparent from Table 22, the samples of the invention show higher sensitivities and more excellent preservabilities with less fall of the sensitivities under high temperature/humidity conditions than the comparative samples.

EXAMPLE 6

The samples 101 to 111 of Example 5, after being allowed to stand under 40° C./80%RH conditions as in Example 5, were evaluated in the same manner as in Example 5 except that the processing alone was replaced by the following processing B.

Consequently, almost the same results as in Table 22 were obtained. Namely, it was confirmed that the effect of the invention is hardly affected by changes in the developing method.

Processing B

A test run of the following processing B was continued until the stabilizer replenishing amount triples the stabilizer tank capacity.

| Processing step | Processing time | Processing temperature | Replenishing amount |
|---|---|---|---|
| Color developing | 3 min. 15 sec. | 38° C. | 540 ml |
| Bleaching | 45 sec. | 38° C. | 155 ml |
| Fixing | 1 min. 45 sec. | 38° C. | 500 ml |
| Stabilizing | 90 sec. | 38° C. | 775 ml |
| Drying | 1 min. | 40 to 70° C. | — |

Each replenishing amount is a value per $m^2$.

The stabilizing was made in a tribath-countercurrent system in which a stabilizer replenisher was put in the final bath so as to overflow into the preceding bath.

Further, part (275 ml/$m^2$) of the overflow from the stabilizer bath following the fixer bath was flowed back into the stabilizer bath.

The compositions of the processing and replenisher solutions used in the above are as follows:

| | |
|---|---|
| Color developer | |
| Potassium carbonate | 30 g |
| Sodium hydrogencarbonate | 2.7 g |
| Potassium sulfite | 2.8 g |
| Sodium bromide | 1.3 g |
| Hydroxylamine sulfate | 3.2 g |
| Sodium chloride | 0.6 g |
| 4-Amino-3-methyl-N-ethyl-N-(β-hydroxylethyl)-aniline sulfate | 4.6 g |
| Diethyltriaminepentaacetic acid | 3.0 g |
| Potassium hydroxide | 1.3 g |
| Water to make 1 liter, adjust pH to 10.01 with potassium hydroxide or 20% sulfuric acid. | |
| Color developer replenisher | |
| Potassium carbonate | 40 g |
| Sodium hydrogencarbonate | 3 g |
| Potassium sulfite | 7 g |
| Sodium bromide | 0.5 g |

-continued

| | |
|---|---|
| Hydroxylamine sulfate | 3.2 g |
| 4-Amino-3-methyl-N-ethyl-N-(β-hydroxylethyl)-aniline sulfate | 6.0 g |
| Diethylenetriaminepentaacetic acid | 3.0 g |
| Potassium hydroxide | 2 g |
| Water to make 1 liter, adjust pH to 10.12 with potassium hydroxide or 20% sulfuric acid. | |
| Bleacher solution | |
| Ferric-ammonium 1,3-diaminopropanetetraacetate | 0.35 mol |
| Disodium ethylenediaminetetraacetate | 2 g |
| Ammonium bromide | 150 g |
| Glacial acetic acid | 40 ml |
| Ammonium nitrate | 40 g |
| Water to make 1 liter, adjust pH to 4.5 with ammonia water or glacial acetic acid. | |
| Bleacher replenisher | |
| Ferric-ammonium 1,3-diaminopropanetetraacetate | 0.40 mol |
| Disodium ethylenediaminetetraacetate | 2 g |
| Ammonium bromide | 170 g |
| Ammonium nitrate | 50 g |
| Glacial acetic acid | 61 ml |
| Water to make 1 liter, adjust pH to 3.5 with ammonia water or glacial acetic acid, and appropriately adjust the bleacher tank solution so as to maintain the pH value. | |
| Fixer and fixer replenisher | |
| Ammonium thiosulfate | 100 g |
| Ammonium thiocyanate | 150 g |
| Anhydrous sodium hydrogencarbonate | 20 g |
| Sodium metabisulfite | 4.0 g |
| Disodium ethylenediaminetetraacetate | 1.0 |
| Water to make 700 ml, adjust pH to 6.5 with ammonia water or glacial acetic acid. | |
| Stabilizer and stabilizer replenisher | |
| 1,2-Benzisothiazoline-3-one | 0.1 g |
| 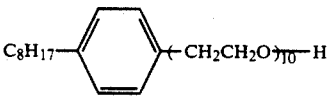 (50% solution) | 2.0 ml |
| Hexamethylenetetramine | 0.2 g |
| Hexahydro-1,3,5-tris-(2-hydroxyethyl)-5-triazine | 0.3 g |
| Water to make 1 liter, adjust pH to 7.0 with potassium hydroxide or 50% sulfuric acid. | |

EXAMPLE 7

The Emulsion II given in Table 18 of Example 5 was chemically ripened with use of sodium thiosulfate, chloroauric acid and ammonium thiocyanate so as to have optimum sensitivities in the same chemical ripening procedure as in Example 5, whereby chemically ripened emulsions were obtained. In this instance, the fine-grained silver halide emulsions shown in Table 19 of Example 5 were also added. The preparation conditions used in the above are shown in Table 23.

TABLE 23

| Chemically ripened Em name | Em name before chemical ripening* | Added fine-grained silver halide or comparative compound: Kind | Added amt** | Added stage | Remarks |
|---|---|---|---|---|---|
| II-1 | II | None | — | — | Comp. |
| II-2 | II | KI | $1.0 \times 10^{-3}$ | Before*** | Comp. |
| II-3 | II | KI | $1.0 \times 10^{-3}$ | After**** | Comp. |
| II-4 | II | KI | $4.0 \times 10^{-3}$ | Before | Comp. |
| II-5 | II | Fine-grained AgX A | $3.0 \times 10^{-4}$ | Before | Inv. |
| II-6 | II | Fine-grained AgX A | $1.0 \times 10^{-3}$ | Before | Inv. |
| II-7 | II | Fine-grained AgX A | $5.0 \times 10^{-3}$ | Before | Inv. |
| II-8 | II | Fine-grained AgX A | $2.0 \times 10^{-2}$ | Before | Inv. |

TABLE 23-continued

| Chemically ripened Em name | Em name before chemical ripening | Added fine-grained silver halide or comparative compound | | | |
|---|---|---|---|---|---|
| | | Kind | Added amt** | Added stage | Remarks |
| II-9 | II | Fine-grained AgX B | $2.5 \times 10^{-3}$ | Before | Inv. |
| II-10 | II | AgX D | $2.5 \times 10^{-3}$ | Before | Comp. |

Note:
*The emulsion given in Table 18 and Table 19 of Example 5.
**Molar amount of Emulsion II per mol of Ag.
***Added 20 minutes before the addition of sodium thiosulfate.
****Added 120 minutes before the addition of sodium thiosulfate.

The ripening shown in Table 23 was performed at 55° C. for 140 minutes.

Samples 201 through 210 were prepared in the same manner as in the following multicolor photographic light-sensitive material except that the silver iodobromide emulsion in the Layer 4 and Layer 7 was replaced as shown in Table 24.

TABLE 24

| Sample | Emulsion in Layer 4, Layer 7 | Sample | Emulsion in Layer 4, Layer 7 |
|---|---|---|---|
| 201 (Comp.) | II-1 | 206 (Inv.) | II-6 |
| 202 (Comp.) | II-2 | 207 (Inv.) | II-7 |
| 203 (Comp.) | II-3 | 208 (Inv.) | II-8 |
| 204 (Comp.) | II-4 | 209 (Inv.) | II-9 |
| 205 (Inv.) | II-5 | 210 (Comp.) | II-10 |

On a subbed triacetyl cellulose film support, the following compositions-having layers were coated in order from the support side, whereby a multicolor light-sensitive material was prepared. Coated weight of each of the components is indicated in g/m² except that silver halide is in silver equivalent.

| | |
|---|---|
| Layer 1: Antihalation layer | |
| UV absorbing agent UV-1 | 0.3 |
| UV absorbing agent UV-2 | 0.4 |
| High-boiling solvent O-1 | 1.0 |
| Black colloidal silver | 0.24 |
| Gelatin | 2.0 |
| Layer 2: Intermediate layer | |
| 2,5-di-t-octylhydroquinone | 0.1 |
| High-boiling solvent O-1 | 0.2 |
| Gelatin | 1.0 |
| Layer 3: Low-speed red-sensitive emulsion layer | |
| AgBrI (AgI: 4.0 mol %, average grain size: 0.25 μm) spectrally sensitized by red-sensitizing dyes S-1 and S-2 | 0.5 |
| Coupler C-3 | 0.3 |
| High-boiling sovent O-2 | 0.6 |
| Gelatin | 1.3 |
| Layer 4: High-speed red-sensitive emulsion layer | |
| AgBrI spectrally sensitized by red-sensitizing dyes S-1 and S-2 | 0.8 |
| Coupler C-3 | 1.0 |
| High-boiling solvent O-2 | 1.2 |
| Gelatin | 1.8 |

-continued

| | |
|---|---|
| Layer 5: Intermediate layer | |
| 2,5-di-t-octylhydroquinone | 0.1 |
| High-boiling solvent O-1 | 0.2 |
| Gelatin | 0.9 |
| Layer 6: Low-speed green-sensitive emulsion layer | |
| AgBrI (AgI: 3.5 mol %, average grain size: 0.25 μm) spectrally sensitized by green-sensitizing dyes S-3 and S-4 | 0.6 |
| Coupler M-2 | 0.15 |
| Coupler M-4 | 0.04 |
| High-boiling solvent O-3 | 0.5 |
| Gelatin | 1.4 |
| Layer 7: High-speed green-sensitive emulsion layer | |
| AgBrI spectrally sensitized by green-sensitizing dyes S-3 and S-4 | 0.9 |
| Coupler M-2 | 0.56 |
| Coupler M-4 | 0.12 |
| High-boiling solvent O-3 | 1.0 |
| Gelatin | 1.5 |
| Layer 8: Intermediate layer | |
| The same as Layer 5 | |
| Layer 9: Yellow filter layer | |
| Yellow colloidal silver | 0.1 |
| Gelatin | 0.9 |
| 2,5-dioctylhydroquinone | 0.1 |
| High-boiling solvent O-1 | 0.2 |
| Layer 10: Low-speed blue-sensitive emulsion layer | |
| AgBrI (AgI: 2.5 mol %, average grain size: 0.35 μm) spectrally sensitized by blue-sensitizing dye S-5 | 0.6 |
| Coupler Y-2 | 1.4 |
| High-boiling solvent O-3 | 0.6 |
| Gelatin | 1.3 |
| Layer 11: High-speed blue-sensitive emulsion layer | |
| AgBrI (AgI: 2.5 mol %, average grain size: 0.9 μm) spectrally sensitized by blue-sensitizing dye S-5 | 0.9 |
| Coupler Y-2 | 3.5 |
| High-boiling solvent O-3 | 1.4 |
| Gelatin | 2.1 |
| Layer 12: First protective layer | |
| UV abosrbing agent UV-1 | 0.3 |
| UV absorbing agent UV-2 | 0.4 |
| 2,5-di-t-octylhydroquinone | 0.1 |
| High-boiling solvent O-3 | 0.6 |
| Gelatin | 1.2 |

Besides the above components, gelatin hardener H-1 and a surfactant were added to each of the above layers. Tricresyl phosphate was used as a solvent for the couplers.

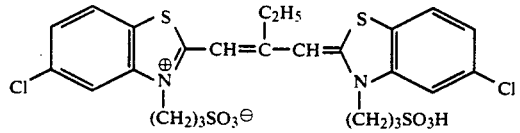

Sensitizing dye S-1

-continued
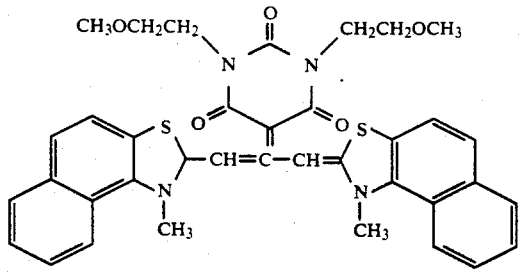
Sensitizing dye S-2
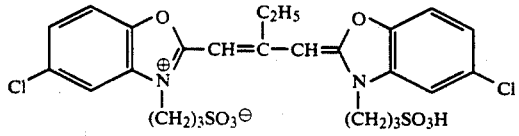
Sensitizing dye S-3
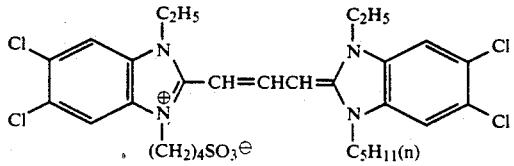
Sensitizing dye S-5
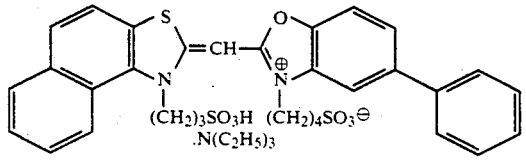
Coupler C-3
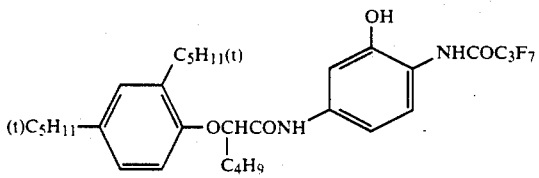
Coupler M-4
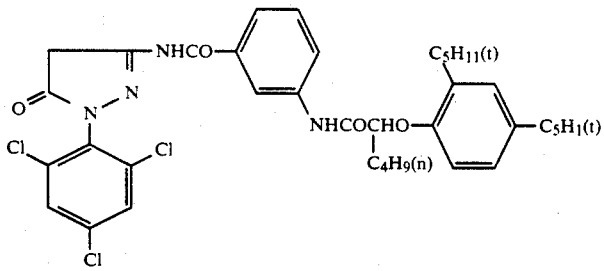
Gelatin hardener H-1
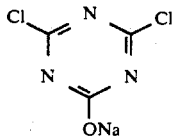
Surfactant SA-1
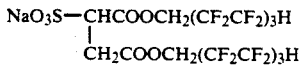
O-1
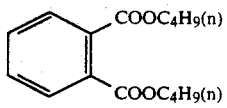

-continued

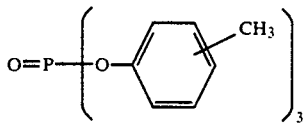

O-2

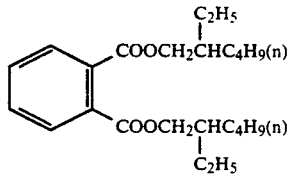

O-3

The above-prepared Samples 201 through 210 were each allowed to stand under 55° C./70%RH conditions for 5 days. The samples thus aged and the same non-aged were each exposed to a white light through an optical wedge loaded with Eastman Kodak Wratten filters W-26 (red) and W-99 (green), and then processed in the following steps:

| Processing step | Time | Temperature |
|---|---|---|
| First developing | 6 minutes | 38° C. |
| Washing | 2 minutes | " |
| Reversing | 2 minutes | " |
| Color developing | 6 minutes | " |
| Compensating | 2 minutes | " |
| Bleaching | 6 minutes | " |
| Fixing | 4 minutes | " |
| Washing | 4 minutes | " |
| Stabilizing | 1 minutes | Room temperature |
| Drying | | |

The compositions of the processing solutions used in the above processing are as follows:

| | |
|---|---|
| First developer | |
| Sodium tetrapolyphosphate | 2 g |
| Sodium sulfite | 20 g |
| Hydroquinone monosulfonate | 30 g |
| Sodium carbonate, monohydrated | 30 g |
| 1-Phenyl-4-methyl-4-hydroxymethyl-3-pyrazolidone | 2 g |
| Potassium bromide | 2.5 g |
| Potassium thiocyanate | 1.2 g |
| Potassium iodide (0.1% solution) | 2 ml |
| Water to make 1 liter | |
| Reversal solution | |
| Hexasodium nitrilotrimethylenesulfonate | 3 g |
| Stannous chloride, dihydrated | 1 g |
| p-Aminophenol | 0.1 g |
| Sodium hydroxide | 8 g |
| Glacial acetic acid | 15 ml |
| Water to make 1 liter | |
| Color developer | |
| Sodium tetrapolyphosphate | 3 g |
| Sodium sulfite | 7 g |
| Sodium triphosphate, dihydrated | 36 g |
| Potassium bromide | 1 g |
| Potassium iodide (0.1% solution) | 90 ml |

-continued

| | |
|---|---|
| Sodium hydroxide | 3 g |
| Citrazic acid | 1.5 g |
| N-ethyl-N-β-methanesulfonamidoethyl-3-methyl-4-aminoaniline sulfate | 11 g |
| 2,2-ethylenedithiodiethanol | 1 g |
| Water to make 1 liter | |
| Compensating solution | |
| Sodium sulfite | 12 g |
| Sodium ethylenediaminetetraacetate, dihydrated | 8 g |
| Thioglycerol | 0.4 ml |
| Glacial acetic acid | 3 ml |
| Water to make 1 liter | |
| Bleaching bath | |
| Sodium ethylenediaminetetraacetate, dihydrated | 2 g |
| Ferric-ammonium ethylenediaminetetraacetate, dihydrated | 120 g |
| Ammonium bromide | 100 g |
| Water to make 1 liter | |
| Fixer bath | |
| Ammonium thiosulfate | 80 g |
| Sodium sulfite | 5 g |
| Sodium hydrogensulfite | 5 g |
| Water to make 1 liter | |
| Stabilizer bath | |
| Formaline (37% by weight) | 5 ml |
| Koniducks (product of KONICA Corp.) | 5 ml |
| Water to make 1 liter | |

The density of each processed sample was measured through a Status A filter by a Densitometer 310, manufactured by X-Light Co. to thereby find its relative sensitivity.

The red density (R) of the area exposed through the red-separation filter W-26 and the green density (G) of the area exposed through the green-separation filter W-99 of each processed sample were measured, whereby the respective maximum color densities and color separation exposure sensitivities were obtained.

The separation exposure sensitivity is a reciprocal of the exposure amount necessary to give a formed color density of 1.0, and indicated with a value relative to the red-separation exposure sensitivity or green-separation exposure sensitivity of non-aged Sample 201 Set at 100. The results are shown in Table 25.

TABLE 25

| | Red maximum density | | Green maximum density | | Red-separation exposure sensitivity | | Green-separation exposure sensitivity | |
|---|---|---|---|---|---|---|---|---|
| Sample | Non-aged | 55° C. 70% RH 5 days | Non-aged | 55° C. 70% RH 5 days | Non-aged | 55° C. 70% RH 5 days | Non-aged | 55° C. 70% RH 5 days |
| 201 (Comp.) | 3.00 | 2.60 | 3.30 | 2.85 | 100 | 85 | 100 | 80 |
| 202 (Comp.) | 3.05 | 2.90 | 3.40 | 3.15 | 70 | 60 | 75 | 60 |
| 203 (Comp.) | 3.00 | 2.80 | 3.25 | 3.10 | 85 | 80 | 85 | 75 |

TABLE 25-continued

| Sample | Red maximum density | | Green maximum density | | Red-separation exposure sensitivity | | Green-separation exposure sensitivity | |
|---|---|---|---|---|---|---|---|---|
| | Non-aged | 55° C. 70% RH 5 days | Non-aged | 55° C. 70% RH 5 days | Non-aged | 55° C. 70% RH 5 days | Non-aged | 55° C. 70% RH 5 days |
| 204 (Comp.) | 3.15 | 3.05 | 3.50 | 3.30 | 55 | 45 | 50 | 50 |
| 205 (Inv.) | 2.95 | 2.90 | 3.20 | 3.10 | 110 | 105 | 105 | 100 |
| 206 (Inv.) | 3.05 | 3.00 | 3.55 | 3.30 | 130 | 135 | 125 | 125 |
| 207 (Inv.) | 5.05 | 3.05 | 3.40 | 3.30 | 115 | 115 | 115 | 115 |
| 208 (Inv.) | 3.10 | 3.00 | 3.50 | 3.40 | 105 | 95 | 100 | 95 |
| 209 (Inv.) | 3.00 | 2.90 | 3.35 | 3.25 | 120 | 110 | 115 | 110 |
| 210 (Comp.) | 3.00 | 2.70 | 3.30 | 3.00 | 100 | 90 | 95 | 85 |

As is apparent from Table 25, the samples of the invention show higher color separation exposure sensitivities, less fall of the densities and sensitivities under high temperature/humidity conditions and thus have more excellent preservabilities than the comparative samples.

EXAMPLE 8

A uniform composition-having silver chlorobromide mother grains Emulsion V was prepared in the following manner:

Preparation of Emulsion V

The following Solution A and Solution B, with pAg and pH controlled to 6.5 and 3.0, respectively, were simultaneously added in 30 minutes to an aqueous 2% gelatin solution, and further to the solution the following Solution C and Solution D, with pAg and pH controlled to 7.3 and 5.5, respectively, were added simultaneously in 180 minutes.

In this instance, the pAg control was performed in accordance with the method described in JP O.P.I. No. 45437/1984, and the pH control was made with use of sulfuric acid or sodium hydroxide.

| | |
|---|---|
| Solution A | |
| Sodium chloride | 2.75 g |
| Potassium bromide | 1.40 g |
| Water to make 200 ml | |
| Solution B | |
| Silver nitrate | 10 g |
| Water to make 200 ml | |
| Solution C | |
| Sodium chloride | 82.6 g |
| Potassium bromide | 42.0 g |
| Water to make 600 ml | |
| Solution D | |
| Silver nitrate | 300 g |
| Water to make 600 ml | |

After completion of the addition, the liquid was desalted by using an aqueous 5% solution of Demol N, produced by Kawo Atlas Co., and an aqueous 20% magnesium sulfate solution, and then mixed with a gelatin solution, whereby a 80 mol % silver chloride-containing monodispersed octahedral grains emulsion V having an average grain diameter of 0.80 μm and a variation coefficient ($\sigma/r$) of 0.07 was prepared.

Besides, silver chlorobromide emulsions VI and VII having the same halide composition as but different grain diameters from the above emulsion were prepared by arbitrarily changing pAg, pH, adding amounts and mixing time in the addition. These mother grains are collectively shown in Table 26.

TABLE 26

| Emulsion | Average grain size (μm) | (Mother grains) Halide composition (mol %) Cl | Br | Other characteristics |
|---|---|---|---|---|
| V | 0.4 | 80 | 20 | Monodispersed octahedral grains having a uniform halide composition |
| VI | 0.8 | 80 | 20 | Monodispersed octahedral grains having a uniform halide composition |
| VII | 1.0 | 80 | 20 | Monodispersed octahedral grains having a uniform halide composition |

The Emulsions V to VII in Table 26 were each subjected to optimum chemical sensitization, in which sensitization process the silver halide fine grains shown in Table 19 of Example 5 were added, whereby the chemically ripened emulsions given in Table 27 were obtained.

TABLE 27

| Ripened Em Name | Em Name before ripening | Added fine-grained silver halide or comparative compound Kind* | Added amt** | Remarks |
|---|---|---|---|---|
| V-1 | V | None | — | Comp. |
| V-2 | V | KBr | $1.0 \times 10^{-1}$ | Comp. |
| V-3 | V | Fine-grained silver halide B | $1.0 \times 10^{-3}$ | Inv. |
| VI-1 | VI | None | — | Comp. |
| VI-2 | VI | KBr | $1.0 \times 10^{-1}$ | Comp. |
| VI-3 | VI | Fine-grained silver halide B | $6.0 \times 10^{-4}$ | Inv. |
| VII-1 | VII | None | — | Comp. |
| VII-2 | VII | KBr | $1.0 \times 10^{-1}$ | Comp. |
| VII-3 | VII | Fine-grained silver halide A | $2.0 \times 10^{-4}$ | Inv. |
| VII-4 | VII | Fine-grained silver halide B | $5.0 \times 10^{-4}$ | Inv. |
| VII-5 | VII | Fine-grained silver halide C | $2.0 \times 10^{-3}$ | Inv. |

Note:
*Emulsion given in Table 19 of Example 5.
**Molar amount per mol of silver of the emulsion before chemical sensitization.
Chemical sensitization conditions: 55° C. for 120 minutes.
The above fine-grained silver halide or KBr was added 20 minutes before stopping the chemical sensitization.

Samples 301 to 307 were prepared in the same manner as in the following multicolor photographic light-sensitive material except that the silver halide emulsions (1) to (3) of Layer 6 and Layer 7 were replaced as shown in Table 28.

TABLE 28

| Sample | Layer 6 Emulsion(1) | Layer 6 Emulsion(2) | Layer 7 Emulsion(3) |
|---|---|---|---|
| 301 (Comp.) | V-1 | VI-1 | VII-I |
| 302 (Comp.) | V-2 | VI-2 | VII-2 |
| 303 (Comp.) | V-3 | VI-3 | VII-3 |
| 304 (Inv.) | V-3 | VI-3 | VII-4 |
| 305 (Inv.) | V-3 | VI-3 | VII-5 |
| 306 (Comp.) | The same emulsions as those of Sample 301 coated after being aged at 5° C. for 14 days following chemical sensitization. | | |
| 307 (Inv.) | The same emulsions as those of Sample 304 coated after being aged at 5° C. for 14 days following chemical sensitization | | |

The samples 301 to 305 were coated upon completion of their chemical sensitization.

On a triacetyl cellulose film support the following compositions-having layers were formed in order from the support side to thereby prepare a multicolor photographic light-sensitive material.

| | |
|---|---|
| Layer 1: Antihalation layer HC | |
| Black colloidal silver | 0.15 |
| UV absorbing agent UV-1 | 0.20 |
| Colored cyan coupler CC-1 | 0.02 |
| High-boiling solvent Oil-1 | 0.20 |
| High-boiling solvent Oil-2 | 0.20 |
| Gelatin | 1.6 |
| Layer 2: Intermediate layer IL-1 | |
| Gelatin | 1.3 |
| Layer 3: Low-speed red-sensitive emulsion layer RL | |
| Silver chlorobromide emulsion (AgBr: 20 mol %, average grain size 0.4 μm) | 0.4 |
| Silver chlorobromide emulsion (AgBr: 2O mol %, average grain size 0.8 μm) | 0.3 |
| Sensitizing dye S-11 | $3.2 \times 10^{-4}$ |
| Sensitizing dye S-12 | $3.2 \times 10^{-4}$ |
| Sensitizing dye S-13 | $0.2 \times 10^{-4}$ |
| Cyan coupler C-1 | 0.50 |
| Cyan coupler C-4 | 0.13 |
| Colored cyan coupler CC-1 | 0.07 |
| DIR compound D-3 | 0.006 |
| DIR compound D-1 | 0.01 |
| Additive SC-2 | 0.003 |
| High-boiling solvent Oil-2 | 0.55 |
| Gelatin | 1.0 |
| Layer 4: High-speed red-sensitive emulsion layer RH | |
| Silver chlorobromide emulsion (AgBr: 20 mol %, average grain size: 1.0 μm) | 0.9 |
| Sensitizing dye S-11 | $1.7 \times 10^{-4}$ |
| Sensitizing dye S-12 | $1.6 \times 10^{-4}$ |
| Sensitizing dye S-13 | $0.1 \times 10^{-4}$ |
| Cyan coupler C-2 | 0.23 |
| Colored cyan coupler CC-1 | 0.03 |
| DIR compound D-1 | 0.02 |
| High-boiling solvent Oil-1 | 0.25 |
| Additive SC-2 | 0.003 |
| Gelatin | 1.0 |
| Layer 5: Intermediate layer IL-2 | |
| Gelatin | 0.8 |
| Layer 6: Low-speed green-sensitive emulsion layer GL | |
| Silver halide emulsion (1) | 1.0 |
| Silver halide emulsion (2) | 0.2 |
| Sensitizing dye S-14 | $6.7 \times 10^{-4}$ |
| Sensitizing dye S-15 | $0.8 \times 10^{-4}$ |
| Magenta coupler M-1 | 0.43 |
| Magenta coupler M-2 | 0.5 |
| Colored magenta coupler CM-2 | 0.10 |

-continued

| | |
|---|---|
| DIR compound D-2 | 0.02 |
| High-boiling solvent Oil-2 | 0.70 |
| Additive SC-2 | 0.003 |
| Gelatin | 1.0 |
| Layer 7: High-speed green-sensitive emulsion layer GH | |
| Silver halide emulsion (3) | 0.9 |
| Sensitizing dye S-16 | $1.1 \times 10^{-4}$ |
| Sensitizing dye S-17 | $2.0 \times 10^{-4}$ |
| Sensitizing dye S-18 | $0.3 \times 10^{-4}$ |
| Magenta coupler M-1 | 0.13 |
| Magenta coupler M-2 | 0.03 |
| Colored magenata coupler CM-3 | 0.04 |
| DIR compound D-2 | 0.004 |
| High-boiling solvent Oil-2 | 0.35 |
| Additive SC-2 | 0.003 |
| Gelatin | 1.0 |
| Layer 8: Yellow filter layer YC | |
| Yellow colloid layer | 0.1 |
| Additive HS-1 | 0.07 |
| Additive HS-2 | 0.07 |
| Additive HS-3 | 0.12 |
| High-boiling solvent Oil-2 | 0.15 |
| Gelatin | 1.0 |
| Layer 9: Low-speed blue-sensitive emulsion layer BL | |
| Silver chlorobromide emulsion (AgBr: 20 mol %, average grain size: 0.4 μm) | 0.25 |
| Silver chlorobromide emulsion (AgBr: 20 mol %, average grain size: 0.8 μm) | 0.25 |
| Sensitizing dye S-9 | $5.8 \times 10^{-4}$ |
| Yellow coupler Y-1 | 0.60 |
| Yellow coupler Y-2 | 0.32 |
| DIR compound D-1 | 0.006 |
| DIR compound D-2 | 0.003 |
| High-boiling solvent Oil-2 | 0.18 |
| Additive SC-2 | 0.004 |
| Gelatin | 1.3 |
| Layer 10: High-speed blue-sensitive emulsion layer BH | |
| Silver chlorobromide emulsion (AgBr: 20 mol %. average grain size: 1.0 μm) | 0.5 |
| Sensitizing dye S-20 | $3.0 \times 10^{-4}$ |
| Sensitizing dye S-21 | $1.2 \times 10^{-4}$ |
| Yellow coupler Y-1 | 0.18 |
| Yellow coupler Y-2 | 0.10 |
| High-boiling solvent Oil-2 | 0.05 |
| Additive SC-2 | 0.002 |
| Gelatin | 1.0 |
| Layer 11: First protective layer Pro-1 | |
| Silver iodobromide emulsion Em-5 | 0.3 |
| UV absorbing agent UV-1 | 0.07 |
| UV absorbing agent UV-2 | 0.1 |
| High-boiling solvent Oil-1 | 0.07 |
| High-boiling solvent Oil-3 | 0.07 |
| Formalin scavenger HS-1 | 0.1 |
| Formalin scavenger HS-2 | 0.2 |
| Gelatin | 0.8 |
| Layer 12: Second protective layer Pro-2 | |
| Surfactant SU-1 | 0.004 |
| Surfactant SU-2 | 0.02 |
| Alkali-soluble matting agent (average particle size: 2 μm) | 0.13 |
| Poly(methyl methacrylate) (average particle size: 3 μm) | 0.02 |
| Sliding agent WAX-1 | 0.04 |
| Gelatin | 0.5 |

Besides the above components, to each layer were added as needed coating aid SU-4, dispersing aid SU-3, hardeners H-1, H-2 and H-3, stabilizer ST-1, antiseptic agent DI-1 and antifoggants AF-I and AF-2.

The compounds used are as follows:

S-11
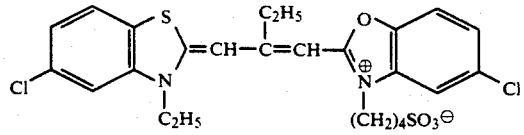
S-12
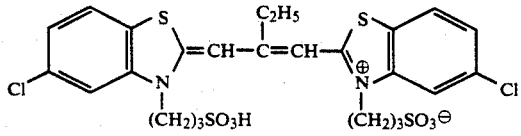
S-13
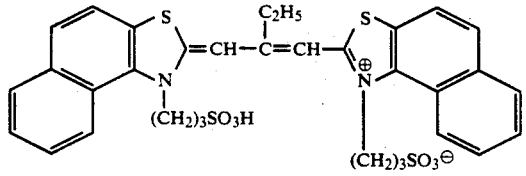
S-14
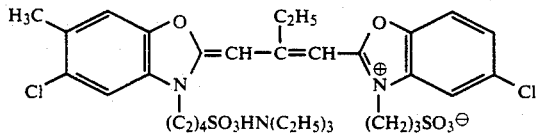
S-15
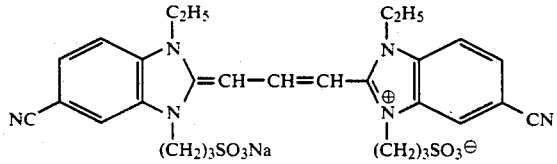
S-16
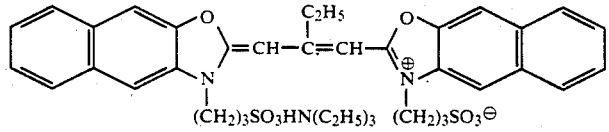
S-17
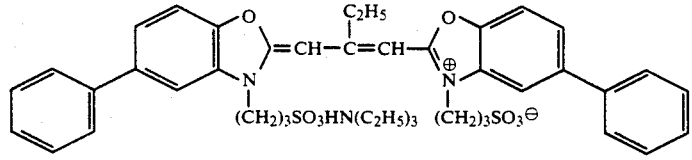
S-18
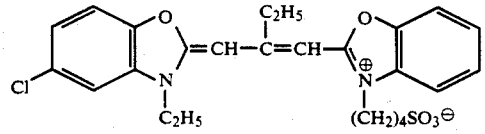
S-19
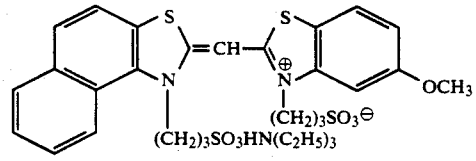
S-20
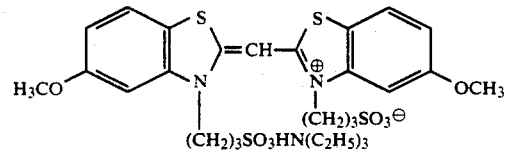

-continued
S-21
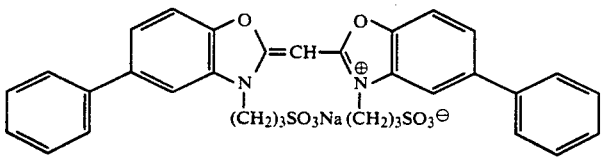
C-4
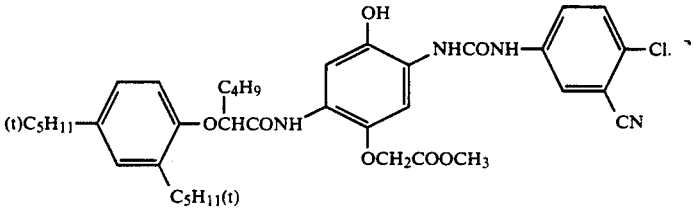
CM-2
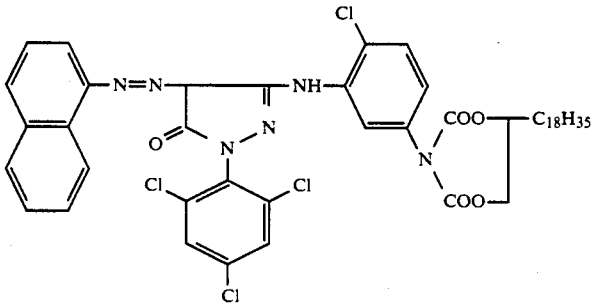
CM-3
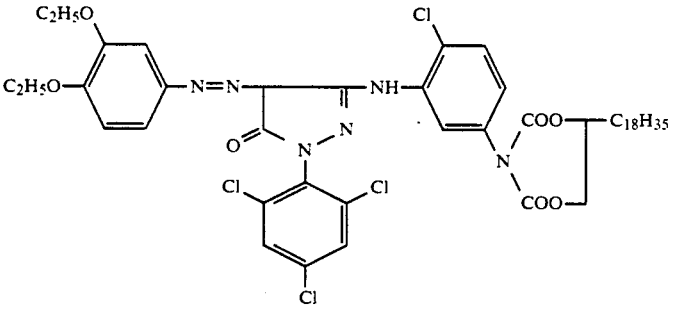
D-4
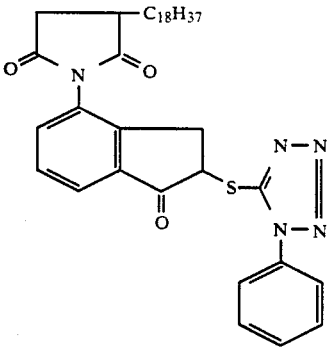
$[(CH_2{=}CHSO_2CH_2)_3CCH_2SO_2CH_2CH_2]_2NCH_2CH_2SO_3K$ H-3
$NaO_3S{-}CH(CH_2COOCH_2(CF_2CF_2)_3H)COOCH_2(CF_2CF_2)_3H$ SU-1

-continued

SU-3

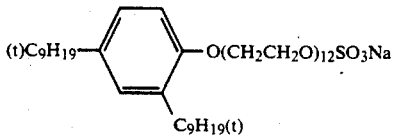

SC-2

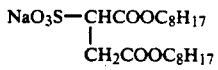

SC-2

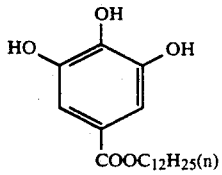

SC-3

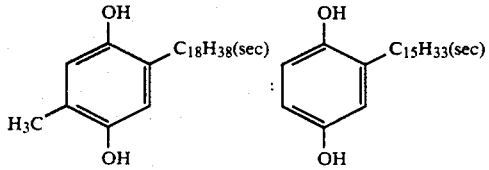

Mixture (2:3)

D-1

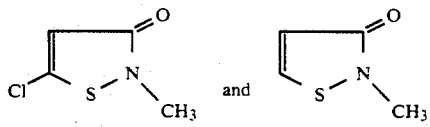

The above-prepared Samples 301 through 307 were allowed to Stand under 30° C./90%RH conditions for 5 days. The samples thus aged and the same nonaged were each exposed through an optical wedge provided with an Eastman Kodak Wratten Filter W-99 (green) to a white light, and then processed under the same conditions as in Example 6.

The green density of each processed sample was measured to find the green layer's sensitivity.

The sensitivity is a reciprocal of the exposure amount necessary to give a green Dmax+0.4 density and indicated in a value relative to the green sensitivity of the non-aged Sample 301 set at 100. The results are shown in Table 29.

TABLE 29

| Sample | Green sensitivity non-aged | Green sensitivity aged at 30° C./90% RH for 5 days |
|---|---|---|
| 301 (Comp.) | 100 | 75 |
| 302 (Comp.) | 100 | 90 |
| 303 (Inv.) | 120 | 120 |
| 304 (Inv.) | 130 | 125 |
| 305 (Inv. | 125 | 115 |
| 306 (Comp.) | 85 | 70 |
| 307 (Inv.) | 130 | 125 |

As is apparent from Table 29, the samples of the invention show higher sensitivities, less fall of the sensitivities under high temperature/humidity conditions and more excellent aging stability after the chemical ripening in manufacture than the comparative samples.

What is claimed is:

1. A silver halide photographic light sensitive material comprising a support having a silver halide emulsion layer thereon, said silver halide emulsion layer comprising silver halide grains having a surface phase and an internal phase adjacent said surface phase, said surface phase having a thickness of from one to five atom phases, said internal phase having a thickness of not more than 100 Å, wherein the silver iodide content of said surface phase is higher than that of said internal phase.

2. The material of claim 1, wherein said surface phase consists of a first atom phase.

3. The material of claim 1, wherein said surface phase consists of a first atom phase and a second atom phase.

4. The material of claim 1, wherein said surface phase consists of a first atom phase, a second atom phase and a third atom phase.

5. The material of claim 1, wherein said surface phase consists of a first atom phase, a second atom phase, a third atom phase and a fourth atom phase.

6. The material of claim 1, wherein said surface phase consists of a first atom phase, a second atom phase, a third atom phase, a fourth atom phase and a fifth atom phase.

7. The material of claim 1, wherein the silver iodide content of said surface phase is not less than 5 mol %.

8. The material of claim 1, wherein the silver iodide content of said surface phase is not less than 10 mol %.

9. The material of claim 1, wherein the silver iodide content of said surface phase is not less than 15 mol %.

10. The material of claim 1, wherein the silver iodide content of said internal phase is less than 5 mol %.

11. The material of claim 1, wherein said silver halide grains are prepared by a method comprising adding fine-grained silver halide grains represented by the following Formula 1 at a stage from a chemical ripening stage to a coating stage to mother grains whose halogen composition of the outermost phase is $AgCl_aBr_bI_c$, wherein $0 \leqq a \leqq 1$, $0 \leqq b \leqq 1$, $0 \leqq c \leqq 0.2$, and $a+b+c=1$;

$$AgCl_{a'}Br_{b'}I_{c'} \qquad \text{Formula 1}$$

wherein $0 \leqq a' \leqq 1$, $0 \leqq b' \leqq 1$, $0 < c' \leqq 1$, $a'+b'+c'=1$, and $c < c'$.

12. The material of claim 11, wherein said mother grains are selected from silver chlorobromide, silver iodobromide and silver chloroiodobromide.

13. The material of claim 11, wherein the grain size of said mother grains has a diameter of from 0.3 to 3.0 μm.

14. The material of claim 11, wherein said mother grains are silver iodobromide or silver chloroiodobromide having an average silver iodide content of 0.5 to 20 mol %.

15. The material of claim 11, wherein said mother grains are silver iodobromide having an average silver iodide content of 2.0 to 15 mol %.

16. The material of claim 11, wherein the grain size of said fine-grained silver halide grain has a diameter of not more than 0.2 μm.

17. The material of claim 11, wherein the grain size of said fine-grained silver halide grain has a diameter of 0.02 to 0.1 μm.

18. The material of claim 11, wherein said c and c' have the following relation:

$$0 < c \leqq 0.05 \text{ and } c' \geqq 0.12.$$

19. The material of claim 11, wherein said c and c' have the following relation:

$$0 < c \leqq 0.04 \text{ and } c' = 1.$$

20. The material of claim 11, wherein said c, b and c' have the following relation:

$$c = 0,\ 0.4 \leqq b, \text{ and } c' \geqq 0.12.$$

21. The material of claim 11, wherein said c, b and c' have the following relation:

$$c = 0,\ 0.4 \leqq b, \text{ and } c' = 1.$$

22. The material of claim 11, wherein said c, b and c' have the following relation:

$$c = 0,\ b < 0.4 \text{ and } c' \geqq 0.12.$$

23. The material of claim 11, wherein said adding is conducted in an amount in mols of not more than 1/100d, when an average diameter of said mother grains is d μm.

24. The material of claim 11, wherein said adding is conducted at a chemical ripening process.

* * * * *